US008936173B2

(12) United States Patent
Fleishman

(10) Patent No.: US 8,936,173 B2
(45) Date of Patent: Jan. 20, 2015

(54) AUTOMATIC DISPENSING SYSTEM METHOD AND APPARATUS

(76) Inventor: Brett Fleishman, Sudbury, MA (US)

( * ) Notice: Subject to any disclaimer, the term of this patent is extended or adjusted under 35 U.S.C. 154(b) by 336 days.

(21) Appl. No.: 13/526,883

(22) Filed: Jun. 19, 2012

(65) Prior Publication Data

US 2013/0090759 A1 Apr. 11, 2013

Related U.S. Application Data

(60) Provisional application No. 61/626,925, filed on Oct. 5, 2011, provisional application No. 61/687,345, filed on Apr. 23, 2012, provisional application No. 61/637,812, filed on Apr. 24, 2012.

(51) Int. Cl.
*G07F 11/44* (2006.01)
*G07F 11/28* (2006.01)

(52) U.S. Cl.
CPC ..... *G07F 11/28* (2013.01); *G07F 11/44* (2013.01)
USPC ..... 221/24

(58) Field of Classification Search
CPC ..... G07F 17/32; G07F 11/44; G07F 11/02; G07F 11/04; G07F 11/34
USPC ..... 221/24, 192
See application file for complete search history.

(56) References Cited

U.S. PATENT DOCUMENTS 4,518,098 A 5/1985 Fleischer
5,788,115 A * 8/1998 Halliburton ..... 221/155
5,833,117 A * 11/1998 Kovens et al. ..... 221/24
5,897,022 A * 4/1999 Mann ..... 221/24
5,997,236 A * 12/1999 Picioccio et al. ..... 221/197
6,056,151 A * 5/2000 Peery et al. ..... 221/24
6,155,453 A * 12/2000 Coleman et al. ..... 221/24
6,181,981 B1 * 1/2001 Varga et al. ..... 700/236
6,182,861 B1 2/2001 Kovens et al.
6,209,868 B1 * 4/2001 Norton ..... 273/118 R
6,227,407 B1 * 5/2001 Simeri et al. ..... 221/254
6,270,080 B1 8/2001 Chang
6,293,434 B1 9/2001 Ellis et al.
6,536,625 B2 3/2003 Chang
6,695,698 B1 * 2/2004 Anghelo et al. ..... 463/25
6,856,861 B2 2/2005 Dirksing et al.
6,912,448 B2 6/2005 Shur
6,990,392 B1 1/2006 Meister et al.
7,083,036 B2 8/2006 Adams
7,206,664 B2 4/2007 Schmid
7,231,279 B2 6/2007 Ghidotti
7,284,755 B1 * 10/2007 Bolen ..... 273/109
7,398,921 B2 7/2008 Zito, Jr.
7,451,015 B2 11/2008 Mazur et al.
7,457,685 B2 11/2008 D'Silva
7,487,010 B2 2/2009 Simmons
7,555,360 B1 6/2009 Green et al.
7,766,145 B1 8/2010 Chang
7,775,870 B2 8/2010 Kelly et al.

(Continued)

OTHER PUBLICATIONS

Fructomat Beverage Dispensers; Water Dispenser Beverage Dispensers Juice Dispensers Drink Dispensers; Sep. 9, 2011; http://www.fructomatusa.com/juice_water_dispensers.html.

*Primary Examiner* — Timothy Waggoner
(74) *Attorney, Agent, or Firm* — Bergman & Song LLP; Michael Bergman

(57) ABSTRACT

A vending machine includes a reservoir for holding bulk goods and multiple reconfigurable distribution path devices to release the goods to a purchaser in entertaining fashion.

15 Claims, 16 Drawing Sheets

(56) References Cited

U.S. PATENT DOCUMENTS

| | | | |
|---|---|---|---|
| 7,826,923 | B2 | 11/2010 | Walker et al. |
| 2002/0116088 | A1 | 8/2002 | Rowe |
| 2004/0133306 | A1 | 7/2004 | Schmid |
| 2005/0027601 | A1 | 2/2005 | Walker et al. |
| 2006/0122881 | A1 | 6/2006 | Walker et al. |
| 2006/0161293 | A1 | 7/2006 | William et al. |
| 2006/0282323 | A1 | 12/2006 | Walker et al. |
| 2007/0026916 | A1 | 2/2007 | Juds et al. |
| 2007/0115128 | A1 | 5/2007 | Napolitano |
| 2007/0255450 | A1 | 11/2007 | Mazur et al. |
| 2007/0276537 | A1 | 11/2007 | Walker et al. |
| 2008/0015737 | A1 | 1/2008 | Simmons |
| 2008/0040211 | A1 | 2/2008 | Walker et al. |
| 2008/0290107 | A1 | 11/2008 | Lock et al. |
| 2010/0145508 | A1 | 6/2010 | Peretz |

* cited by examiner

AUTOMATIC DISPENSING SYSTEM METHOD AND APPARATUS

CROSS-REFERENCE TO RELATED APPLICATIONS

The present application claims the benefit under 35 USC §119(e) of U.S. provisional patent application No. 61/626,925, filed on Oct. 5, 2011 and entitled Dispensing Apparatus; U.S. provisional patent application No. 61/687,345, filed on Apr. 23, 2012 and entitled Automatic Dispensing System Method and Apparatus; and U.S. provisional patent application No. 61/637,812, filed on Apr. 24, 2012 and entitled Automatic Dispensing System Method and Apparatus, the disclosures of which are herewith incorporated by reference in their entirety.

FIELD OF THE INVENTION

A vending machine according to principles of the invention includes an entertainment module that is replaceable and/or reconfigurable to provide an amusing interlude during vending of a product.

BACKGROUND

It has long been understood that a key feature of the sales function is to make a product attractive to the potential purchaser. This is captured in the well-known maxim that one "sells the sizzle and not the steak." Notwithstanding the simplicity of this idea, and its long history, it is well understood that attracting customers remains a delicate art, and one where the pool of novel ideas is far from exhausted.

It is also true that the effective use of technology can provide a customer with a sales experience that is superior to one offered by a competitive vendor. Again, there is a long history of advancements in this regard, including such features as the application of scales in the weighing of goods, colorful packaging to make products attractive and computerized online auctions to establish a market price. Notwithstanding this long history of such developments and, when measured across human society, the enormous resources devoted to these efforts, the inventor of the present invention has created systems, methods and devices of substantial novelty and significant commercial value. He has done this by careful analysis and understanding of the existing art and its historical basis, and by the application of careful and creative thought to synthesize a product delivery apparatus and method that represents an important advancement over those previously in existence.

SUMMARY

According to principles of the invention, a vending apparatus includes one or more reservoirs. The reservoirs are arranged to hold goods to be vended or otherwise distributed. The reservoirs will, in some embodiments, include extended anterior portions and, in some cases, lifting mechanisms, to increase available storage capacity. The goods may be unpackaged or packaged for distribution. The goods are released from the reservoirs into an entertaining user interface. The user interface includes apparatus arranged to provide a plurality of paths for the goods through the user interface and to deliver the goods to a vending point. The availability of multiple paths that the goods can traverse, as well as the shape of those paths and various randomization that may be associated with path selection helps to deliver a variable and entertaining user experience.

These and other advantages and features of the invention will be more readily understood in relation to the following detailed description of the invention, which is provided in conjunction with the accompanying drawings.

It should be noted that, while the various figures show respective aspects of the invention, no one figure is intended to show the entire invention. Rather, the figures together illustrate the invention in its various aspects and principles. As such, it should not be presumed that any particular figure is exclusively related to a discrete aspect or species of the invention. To the contrary, one of skill in the art will appreciate that the figures taken together reflect various embodiments exemplifying the invention.

DETAILED DESCRIPTION

The young, and the young at heart, represent an important market for many classes of goods including foodstuffs, snacks, beverages, confectionery products, toys, puzzles and other games of many descriptions and forms. A product delivery system providing superior access to this market segment offers the potential for significant commercial returns.

Various automatic vending systems have been applied to the problem of selling into these markets, some with significant success. These attempts have included traditional rotary plate gumball machines, sandwich vending machines, etc. As noted above, providing a vending system and apparatus that is consistently attractive, particularly to a youthful demographic, is exceptionally challenging. It should be understood that vending, as used herewith, is intended to encompass distribution both for direct payment and for other purposes such as, e.g., the development of goodwill.

To the younger eye, the world reveals itself as novel at every turn, and maintaining a sense of wonder over repeated encounters requires applying a level of creativity not typically found in the marketplace. Moreover, the features that characterize attractive novelty, are constantly changing, particularly in an environment where the competition for purchasers' attention is high. Unlike systems for older audiences, subtle variations can make all the difference. Under such circumstances, it is important to collect and take advantage of available information to maintain the attractiveness of a system so as to sustain sales effectiveness.

Beyond simple attractiveness, the cost-effective sales of products requires an ongoing understanding of the age, condition and status of inventory, and of the funds, and other consideration, received for goods sold. Having given careful and extended thought to these issues, and by diligent and creative effort, the present inventor has arrived at a vending system, method and apparatus as discussed herewith.

A vending machine according to certain principles of the invention includes an entertainment module that is replaceable and/or reconfigurable, and presents various dynamic features to provide an amusing interlude during vending of a product.

Figure 1:
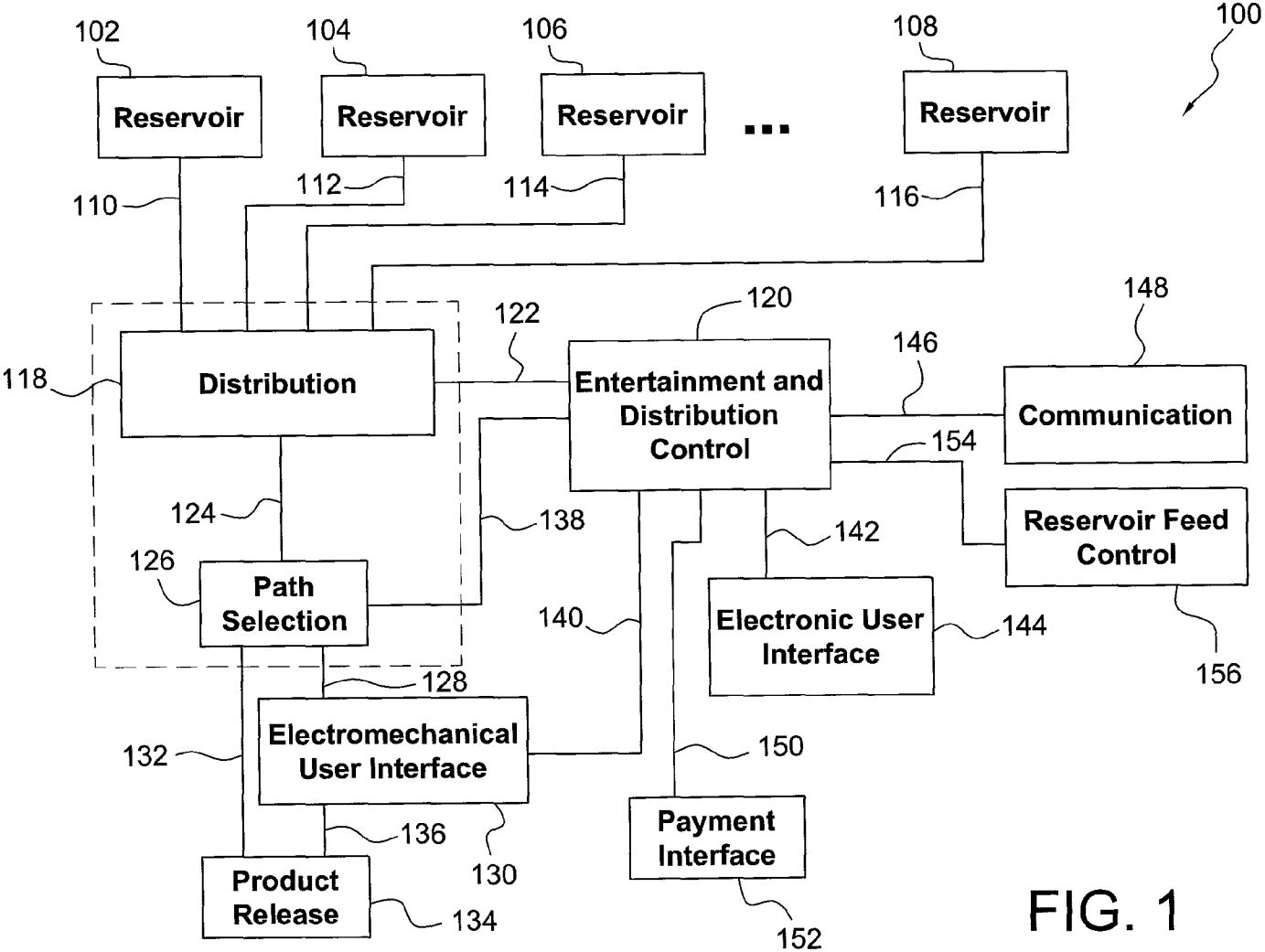
FIG. 1 shows, in schematic block diagram form, components of a vending apparatus according to principles of the invention.

FIG. 1 shows, in schematic form, selected elements of a vending system 100 forming one embodiment of the invention. The exemplary vending system 100 includes a plurality of reservoirs 102, 104, 106, 108, one or more of which can be charged with goods for dispensing. The goods may be in bulk form, such as, for example, unpackaged candy (e.g. Jawbreakers, Jellybeans, Skittles™, etc.), toys (Hot Wheels™ cars, crayons, miniature video games, etc.) and other novelties. A reservoir may also contain goods in quasi-bulk form, where a bulk product such as candy or toys is provided in a plurality of packages such as, for example, plastic spheres or paper envelopes.

Each reservoir is coupled 110, 112, 114, 116 respectively, to a distribution device 118 as shown for the conveyance of goods. As will be discussed in additional detail below, the distribution device 118 includes, in various embodiments, apparatus for controlling the release of goods from the respective reservoirs.

In the illustrated embodiment, a controller device 120 is signalingly coupled 122 to the distribution device 118. In various embodiments, the controller device includes one or more of a microcontroller, a microprocessor, a programmable logic device, an electro-mechanical relay device, and a mechanical control device.

Optionally, and in certain embodiments, distribution device 118 is coupled 124 to a path selection device 126. The path selection device 126 is further coupled 128 to a mechanical (or electromechanical) user interface device 130 and coupled 132 directly to a product release device 134. The path selection device 126 serves to direct the passage of particular goods to the product release device 134, either directly 132 or through the mechanical user interface device 130 which is also coupled 136 to the product release device 134.

In the illustrated embodiment, the controller device 120 is signalingly coupled 138 to the path selection device and 140 to the mechanical user interface device 130. In addition, in certain embodiments, the controller device 120 is signalingly coupled 142 to an electronic user interface device 144. In still further embodiments, the controller device 120 is signalingly coupled 146 to a communication device 148. The communication device 148 may include facilities and systems adapted to provide communication between vending system 100 and an external communications network and/or server.

In a further aspect, controller device 120 is operatively coupled 150 to a payment interface device 152. The payment interface device includes one or more of a coin receiving device, a bill receiving device, a credit card receiving device, a cell phone and/or personal digital assistant (PDA) communication device, and any other device suitable for the receipt or communication of payment such as is known or may become known in the art.

In operation a customer interacts with one or more of the electronic user interface 144 and mechanical user interface 130. Either initially, or upon prompting by the appropriate user interface, the customer provides payment to the payment interface, either by communication of an electronic or other signal, or by the insertion of one or more of, for example, paper money, a coin, and a specialized token.

Responsive to payment by the customer at the payment interface, the controller device 120 provides operative signals to one or more of the distribution device 118, the electronic user interface device 144, the path selection device 126 and the mechanical user interface 130. Further details of this interaction, in various exemplary embodiments, are provided below.

In a further aspect, controller device 120 is operatively coupled 154 to a reservoir feed control apparatus 156. The reservoir feed control apparatus will be further described below at least in the context of FIG. 13.

Figure 2:
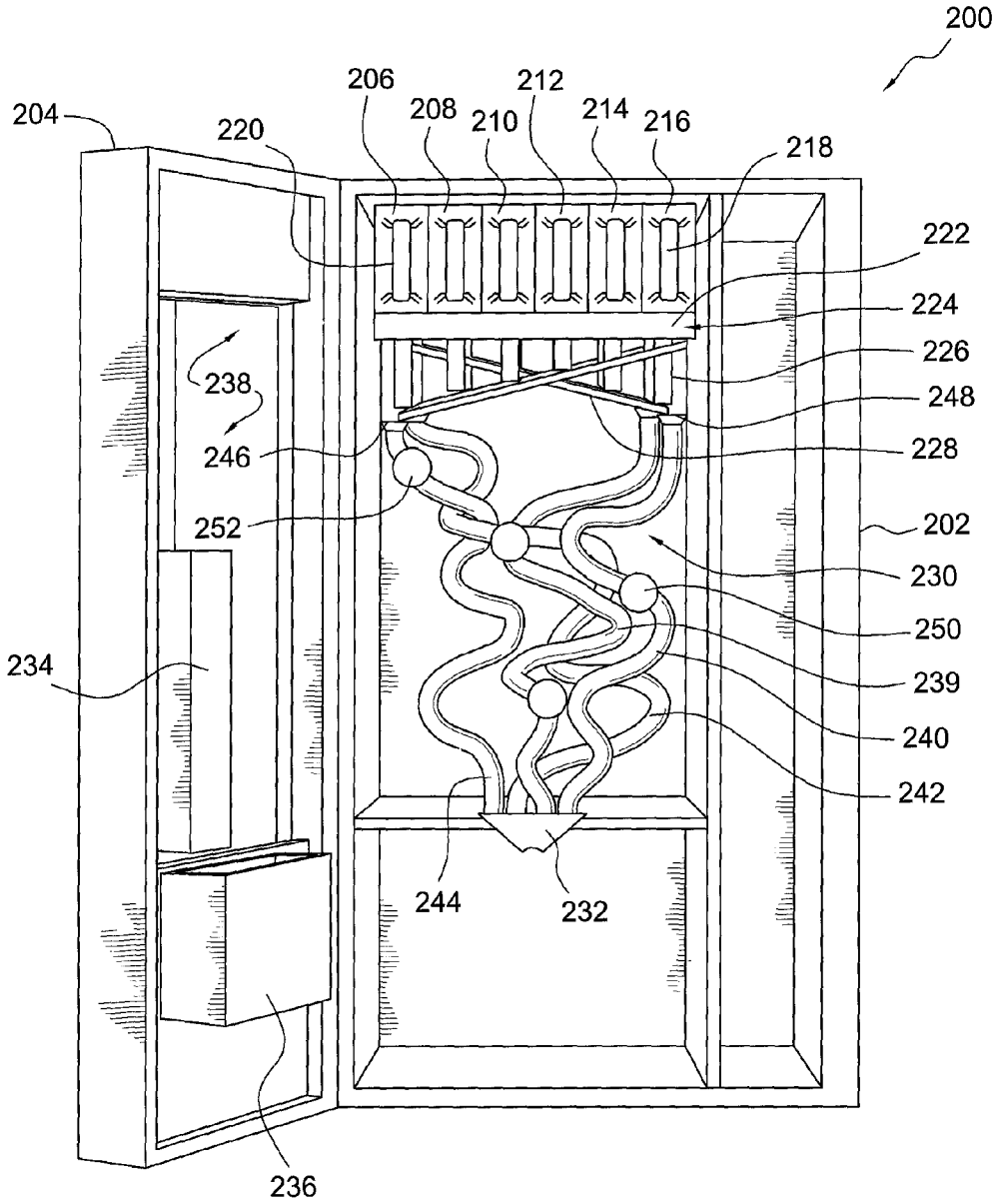
FIG. 2 shows, in schematic perspective view, an exemplary embodiment of a vending system and apparatus according to principles of the invention.

FIG. 2 shows, in schematic perspective view, a vending machine 200 prepared according to principles of the invention. The machine 200 includes a cabinet 202 that provides support for, and enclosure of, the machine's mechanisms. A door 204 is pivotally coupled to the cabinet 202 by a hinge device, providing access for replenishing inventory and servicing of equipment within the cabinet. A plurality of reservoirs 206, 208, 210, 212, 214 and 216 are arranged to receive, respectively, different goods for dispensing. In the illustrated embodiment, the reservoirs are located in an upper region within the cabinet 202 to allow gravity-fed dispensing of the goods.

In the illustrated embodiment, the reservoirs are configured as discrete permanent drawers, each adapted to be individually slidingly withdrawn from the interior of the cabinet. In other embodiments, a single drawer is provided having partitions within the single drawer, the partitions defining individual reservoir compartments. Where partitions are employed, these may include mobile partitions that allow re-configuration of the reservoir spaces defined by the partitions. Consequently, the reservoirs may be adjusted in size to accommodate inventory of various sizes. In some instances, the requirement for a larger inventory space may reflect an inventory consisting of larger individual items, such as, for example, large plastic globes as compared with smaller individual gumballs. In other embodiments, the requirement for a larger inventory space may reflect the differential popularity of a particular item, so that it is desirable to stock a larger quantity of that item, as compared with a less popular inventory item.

In certain embodiments of the invention, adjustment of the reservoir partitions, and consequently of the available inventory volumes, may be effected automatically based on a calculation performed by a controller device within the individual dispensing device. In other embodiments, adjustment of inventory volume is effected automatically based on a calculation performed at a remote location by, for example, a centralized server device. In certain instances, the calculation of desirable inventory volume will reflect local historical sales records and in other instances, the calculation of desirable inventory volumes will reflect one or more of local historical sales records, historical sales records of remote devices and other selected data such as, for example, demographic data related to a population proximate to a geographic location of a machine, characteristics of local business establishments, research regarding changing preferences amongst a likely customer base, and any other information considered to be of value in establishing an optimal inventory of goods.

In still further embodiments of the invention, the reservoirs 206, 208, 210, 212, 214 and 216 are configured as removable packages, pre-charged with a desirable inventory of goods. The removable packages are, in certain embodiments, individual packages and in other embodiments are configured as a unit for common replacement. In certain embodiments the pre-charged packages include both goods for sale and disposable packaging. In other embodiments, the pre-charged packages include goods for sale and recyclable and/or reusable packaging.

In certain embodiments, the reservoirs include respective handles, e.g., 218, 220 adapted to facilitate withdrawal and handling of the reservoirs during inspection and replenishment.

In the illustrated embodiment, the reservoirs are supported on a shelf that includes a distribution device 222. The distribution device is configured and arranged to receive goods from the reservoirs respectively and to release those goods in particular measure for vending. In various embodiments of the invention, the receipt of goods from the reservoirs, and/or the release of goods for vending, is controlled by a controller device. Accordingly, the distribution device 222 is signalingly coupled to a controller device as, for example, indicated above in relation to FIG. 1.

In the exemplary embodiment of FIG. 2, distribution device 222 includes a display surface 224 as well as a plurality of chutes 226 and manifolds 228 adapted to receive goods as they are released from the reservoirs and to deliver those goods to a mechanical user interface device 230. The display surface is adapted to support one or more labels, figures, icons, packaging elements or product samples representing goods available for vending.

Taken together, the distribution device 222, chutes 226 and manifolds 228 constitute a path selection device for the vending machine 200 of FIG. 2. In alternative embodiments, a separate path selection device may be provided to bypass, or otherwise control the passage of goods through, the mechanical user-interface 230. As will be discussed more extensively below, passage of the goods through the mechanical user interface device delivers entertainment value to a purchaser, and to potential purchasers, viewing its activity.

In certain embodiments, goods are received from the mechanical user interface device 230 into a dispensing device 232. The dispensing device 232 will, in certain embodiments, provide goods directly to a purchaser and in other embodiments may dispense the goods into a further package for receipt by the purchaser.

Vending machine 200 also includes a payment interface device 234 supported, in the illustrated embodiment, on door 204. Also supported on door 204 is a control cabinet 236 containing various equipment including, in the illustrated embodiment, a power supply and a controller device. In a further aspect of exemplary vending machine 200, door 204 includes a window or other substantially transparent region 238. Substantially transparent region 238 allows a purchaser to view the mechanical user interface 230 and, in particular, to view operation of the mechanical user interface during the vending of goods.

It will be evident upon observation that the cabinet 202, of vending machine 200, may be readily equipped with ancillary equipment including lighting devices, refrigeration equipment, self-cleaning devices and other equipment appropriate to the requirements of a particular application.

In the illustrated embodiment, the mechanical user-interface device includes a multipath plurality of serpentine tubes eg., 239, 240, 242 and 244, adapted and configured for conveying goods from the distribution device 222 to the dispensing device 232 in an entertaining fashion. According to one aspect of the invention, each tube has a different physical configuration, so the path of goods through any respective tube will differ from the path through another tube. In the illustrated embodiment, selection of a particular candy, for example, will result in the passage of that candy through one tube whereas selection of another candy may result in that second candy traveling through a different tube. In some circumstances, selecting a combination of two candies will result in those candies passing through two different tubes simultaneously. In a further aspect of the invention, it will be possible for a purchaser to make a selection that results in candy passing through all tubes simultaneously. In still other circumstances, determination of which tubes the candies will pass through is made on a randomized basis.

In the illustrated embodiment, the tubes are formed of substantially transparent plastic material such as, for example, polycarbonate material. In other applications, the tube material may be substantially translucent. In any event, the material of the tubes may include a pigment so as to render the tubes colored. In other embodiments, a tube surface will support a colored coating or other surface finish. In certain embodiments, a tube will be disposable and/or recyclable and used only once within a vending machine. In other embodiments a tube will be reused in a second vending machine after being withdrawn from a first vending machine. In still other embodiments, a tube will be reused at a future time in the same vending machine from which it is withdrawn.

The user interface may include a wide variety of materials according to the requirements of a particular application. Thus, in certain embodiments, a tube will include one or more of a glass, metal, a natural polymer and a synthetic polymer. For example, a tube prepared according to principles of the invention may include polycarbonate material. Other polymers for inclusion according to particular embodiments of the invention include polyethylene, polypropylene, polybutylene, polystyrene, polyester, acrylic polymers, polyvinylchloride, polyamide, or polyetherimide like ULTEM®; a polymeric alloy such as Xenoy® resin, which is a composite of polycarbonate and polybutyleneterephthalate or Lexan® plastic, which is a copolymer of polycarbonate and isophthalate terephthalate resorcinol resin (all available from GE Plastics), liquid crystal polymers, such as an aromatic polyester or an aromatic polyester amide containing, as a constituent, at least one compound selected from the group consisting of an aromatic hydroxycarboxylic acid (such as hydroxybenzoate (rigid monomer), hydroxynaphthoate (flexible monomer), an aromatic hydroxyamine and an aromatic diamine, polyesterimide anhydrides with terminal anhydride group or lateral anhydrides or combinations thereof.

In addition, any polymeric composite such as engineering prepregs or composites, which are polymers filled with pigments, carbon particles, silica, glass fibers, conductive particles such as metal particles or conductive polymers, or mixtures thereof may also be used. For example, a blend of polycarbonate and ABS (Acrylonitrile Butadiene Styrene) may be used.

Metallic materials for inclusion in various embodiments of the invention include stainless steel, aluminum, copper, brass, bronze, an alloy such as Ni/Ti alloy; any amorphous metals including those available from Liquid Metal, Inc. and similar ones.

In certain embodiments, the entertainment value of the mechanical user-interface device is rooted in its ability to accelerate goods passing through it in various ways, causing the goods to change speed and direction during the course of their passage. Thus it is desirable that the tubes zig and zag in various ways. For example, the illustrated embodiment includes a plurality of tubes, each having a unique configuration of twists and turns. In particular embodiments of the invention, one or more of the tubes will include a "loop-the-loop" feature so that goods passing through the tube will execute a circular motion in one or more of a vertical orientation, a horizontal orientation and an oblique orientation. In other embodiments, a tube will include one or more of a generally angular feature, a generally sinusoidal feature, generally semicircular feature, and a generally elliptical feature.

According to principles of the invention, in certain embodiments, the vending system will respond to an input from a purchaser, or other user, by transferring goods into and through one or more of the available tubes. In certain embodiments, the tube through which the goods travels is identified to the particular selected product.

In the illustrated embodiment, each tube is equipped with a respective funnel feature e.g., 246, 248, at an upper end thereof, forming an interface to receive goods released by the distribution device 222. As illustrated, the tubes of exemplary vending machine 200 are curved and intertwined in a complex fashion to provide an interesting dispensing path for goods. In addition, each tube is provided with a label or tag, e.g., 250, 252 identifying it for the purchaser and distinguishing it from the other tubes. In a further aspect of the invention, the label or tag may be used to advertise the contents of the vending machine.

According to principles of the invention, the individual tubes are removable and replaceable, allowing reconfiguration of the mechanical user-interface to provide variety and to allow the purchasing experience to vary from time to time. In further embodiments of the invention, each tube includes a plurality of tube segments so that the configuration of an individual tube can be adjusted by rotation of the tube segments relative to one another, and/or by rearrangement of the tube segments.

Figure 3:
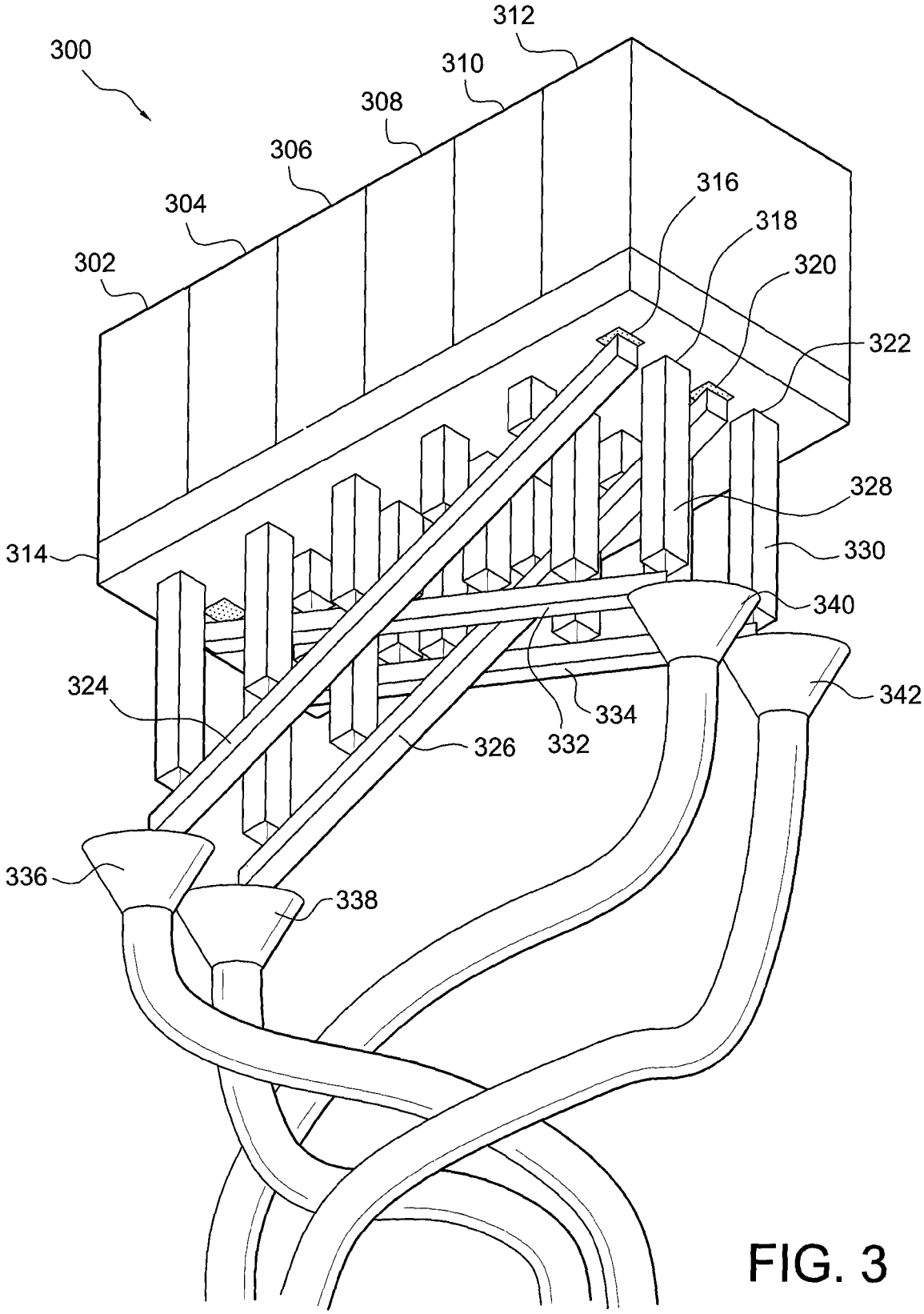
FIG. 3 shows, in schematic perspective view, an exemplary distribution and path selection apparatus according to principles of the invention.

FIG. 3 shows, in schematic perspective view, a further portion 300 of a vending machine prepared according to principles of the invention. In the illustrated embodiment, a plurality of reservoirs 302, 304, 306, 308, 310 and 312 are disposed above a combination distribution and path selection device 314. Four apertures, each controlled by a respective shutter or valve, are arranged to allow the controlled release of goods from each reservoir respectively. Thus, for reservoir 312 apertures are present at locations 316, 318, 320 and 322.

As illustrated, apertures 316 and 320 are arranged to allow goods to drop directly onto respective ramps 324 and 326. Conversely, apertures 318 and 322 are coupled respectively to chutes 328 and 330. The chutes are arranged to convey goods from respective apertures to two further ramps 332, 334, respectively. The chutes are illustrated here, for example, as being substantially cylindrical tubes of rectangular cross-section, and being hollow along their longitudinal axes. Any other useful shape may, of course, be employed.

Within the mechanism of FIG. 3, once released by a respective valve the goods move by gravity so as to fall either directly onto a respective ramp or through a respective chute and onto a respective ramp. Thereafter, the goods slide and/or roll along the ramp, again under the influence of gravity, until received by a flared portion (a funnel) 336, 338, 340, 342 of a respective tube.

Any/or all of the reservoirs, the distribution device, the chutes, the ramps, the funnels and tubes may be formed of or include a transparent or translucent material. Consequently, in certain embodiments of the invention, the passage of goods being dispensed can be viewed along its entire route from the reservoir to a point of release. The motion of the goods, and the ability to observe that motion, will be entertaining to purchasers. Of course it should likewise be understood that, in other embodiments, one or more of the intervening components may include an opaque material that prevents viewing of the goods during any portion of their travel.

The practitioner of ordinary skill in the art will see that the distribution and path selection device 314 is arranged to allow the release of product from any reservoir onto any ramp and consequently into the respective tube. The ramps are arranged at oblique angles with respect to vertical, to ensure a reasonably controlled transfer of product from aperture to funnel. Likewise, the chutes have various lengths consistent with the respective distances between aperture and ramp so that goods released at an aperture consistently fall onto the corresponding ramp in desirable fashion. In the illustrated embodiment, the length of each chute is selected to allow a short freefall of goods onto the ramp from a lower end of the chute, thereby increasing visibility of the goods during this transit and allowing goods released upstream to pass under the chute. While the exemplary chutes are illustrated as being substantially vertical, other embodiments will have chutes disposed at desirable oblique angles.

Once through the funnels and into the respective tubes, the goods proceed along a complex path dictated by the spatial form of the tube, again under the urging of gravity. Of course, it should be understood that while the embodiment of FIG. 3 is intended to show gravitationally motivated operation, alternative motivations are well within the scope of the invention. Thus in certain embodiments, the ramps will include respective active conveyor devices. Likewise in certain embodiments, the tubes will include active conveyor devices. Such conveyor devices may include, for example, wheels, sprockets, gears, chains, belts, a flowing fluid and/or gas including, for example, compressed air, vibratory actuators, centrifugal devices, and magnetic devices including static and dynamic magnetic devices. In addition, it will be understood that active devices are available in certain embodiments to actively switch the path of goods, for example from one tube to another, in random or programmed fashion, or under the control of a purchaser or other user.

As one regards the embodiment of FIG. 3 it should also be understood that the release of goods from the apertures will take place in response to a control signal received at a respective valve or shutter. Consequently, it is within the scope of the invention to arrange for the timing of such a release to provide a further entertainment value. Thus, in some embodiments, and in some circumstances, goods will be released concurrently from a plurality of apertures. In other embodiments and circumstances goods will be released sequentially from a plurality of apertures all optionally under the control of a centralized controller device. The release of goods is timed to provide a desirable confluence of goods at a particular location within the user mechanical interface, for example. This will provide, in some instances, an entertaining collision of goods at various points within the system. In other circumstances goods will be simultaneously directed to more than one funnel and/or tube.

As noted above, novelty is an important element in attracting the attention of customers to a vending machine according to principals of the invention. In order to maintain a novel appearance and effect over time, in one aspect, a system prepared according to principles of the invention includes a modular replaceable user interface apparatus, and in particular a replaceable mechanical user interface module.

Figure 4:
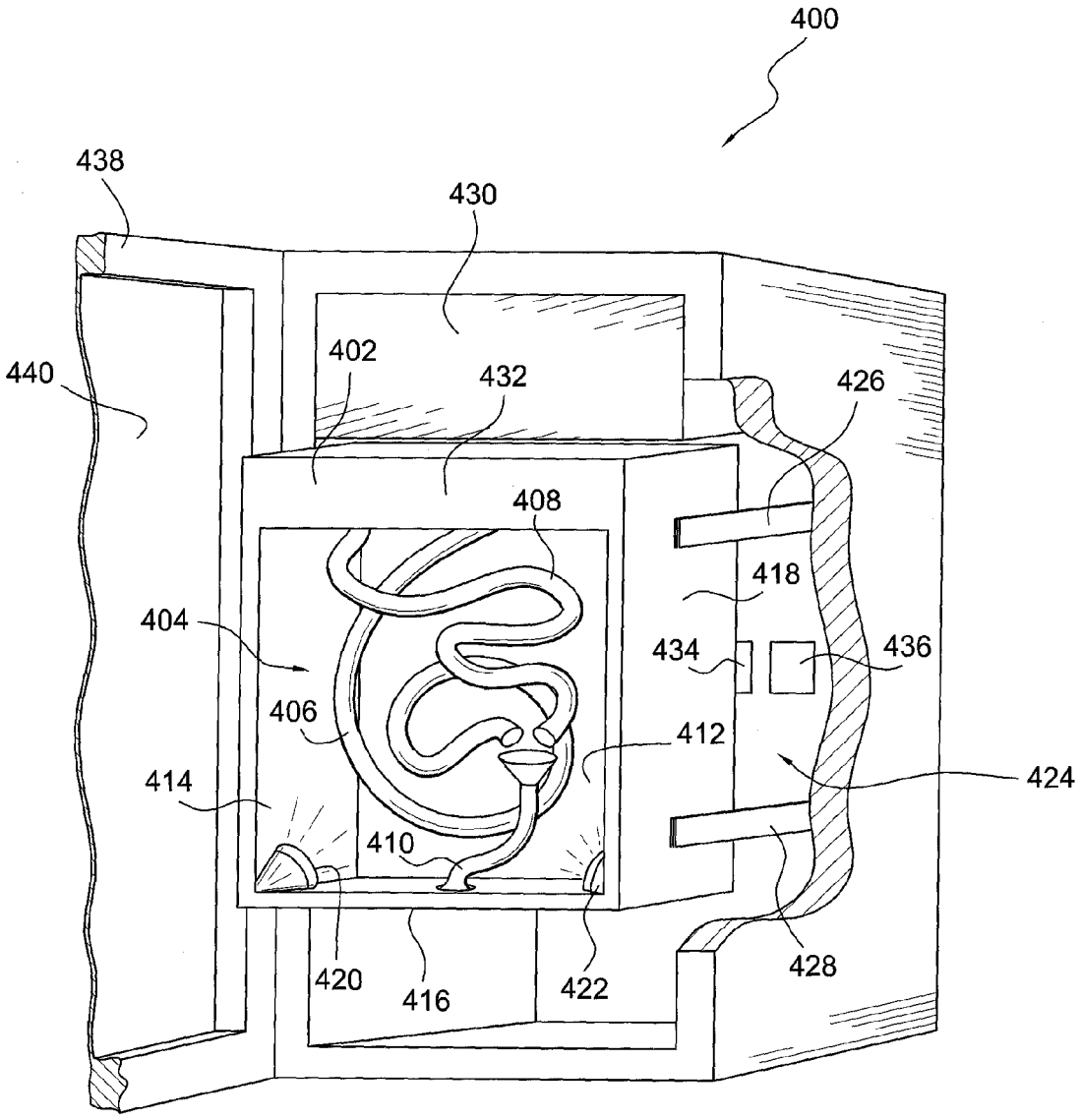
FIG. 4 shows, in schematic cutaway perspective view, an exemplary vending apparatus including a removable entertainment module according to principles of the invention.

FIG. 4 shows one exemplary arrangement consistent with the invention, including a vending apparatus 400 having a replaceable entertainment module 402. The entertainment module 402 includes, in the illustrated embodiment, an entertaining mechanical user interface apparatus 404. The entertaining mechanical user interface 404 is shown here to incorporate several tubes 406, 408, 410 selected and arranged as a multipath serpentine user interface device to guide vended goods along a desirable accelerated path through space. In the illustrated embodiment, the tubes 406, 408 and 410 are represented as substantially cylindrical substantially transparent serpentine tubes. It will be clear to one of skill in the art, however that a wide variety of other guiding devices, as well as other numbers and arrangements of similar tubes will be employed to useful effect in alternate embodiments of the invention.

The entertaining mechanical user interface 404 is optionally (and as illustrated here) disposed within a cavity 412, of the entertainment module 402. The cavity 412 is formed between structural members, e.g., 414, 416, 418 of the module 402 that serve to give the module structural integrity and protect the entertaining mechanical user interface 404 from damage during transportation. In the illustrated embodiment, lighting devices 420, 422 are disposed within the cavity 412 and supported by the structural members to provide desirable illumination of the mechanical user interface 404.

In various embodiments of the invention, the lighting devices 420, 422 will employ one or more of light emitting diodes, incandescent lighting devices, fluorescent lighting devices, laser lighting devices, plasma lighting devices (including, without limitation, neon lighting devices), and any other appropriate illumination device that is known or may become known in the art. In a further aspect of the invention, the lighting devices will be configured and controlled to provide a stroboscopic lighting effect in some embodiments.

In further embodiments of the invention, additional and alternative lighting devices are disposed throughout the cavity 412. Some of these additional and alternative lighting devices are, according to principles of the invention, supported by and/or incorporated into guiding devices such as the illustrated tubes 406, 408, 410. In still further embodiments of the invention, lighting devices are integrally formed onto a guiding device, whereby the guiding device serves as a substrate for formation of, for example, a light emitting diode device. In yet further embodiments of the invention, an illumination device is provided and arranged to illuminate an end or edge of a guiding device such as illustrated tubes 406, 408, 410, where illumination of the end or edge causes a generalized illumination of the tube and/or its contents.

In additional embodiments of the invention, illumination devices including optical fibers are employed for artistic and entertaining effects. In certain of these embodiments, the optical fibers are arranged to provide mobile regions of illumination during operation of the vending apparatus 400.

In additional embodiments of the invention, the vending apparatus 400 will include one or more transducer such as, for example, audio transducers and vibratory transducers. Such transducers will be arranged to provide desirable audio signals such as, e.g., music, simulated explosions, etc. for perception by a purchaser. In addition, the transducers may provide vibratory action to further animate the equipment.

It will be understood that appropriate power amplifiers, and other signaling devices, will be included in various embodiments of the invention. These amplifiers and other devices will be configured to attract the attention of additional potential customers during the process of vending, and/or at other times.

In various embodiments, transducers will be included within the entertainment module 402, and in some embodiments transducers will be included external to the entertainment module within the vending apparatus 400. In still other embodiments of the invention, an interface may be provided for coupling operative signals to additional transducers located external to the vending apparatus 400.

As illustrated, the entertainment module 402 is configured for insertion within a corresponding cavity 424 of the vending apparatus 400. In certain embodiments of the invention, coupling devices such as, for example, drawer slides 426 and 428 are provided to slidingly support the entertainment module 402 and facilitate its insertion into cavity 424. One of skill in the art will appreciate that, while drawer slides are illustrated in FIG. 4, a wide variety of other coupling mechanisms such as slots, rollers, air bearings, etc., will be employed in various respective embodiments according to the requirements and design of a particular application. In certain embodiments of the invention, the coupling mechanism will include an actuator such as, e.g., a motor, or other active mechanism, arranged to facilitate lifting and/or insertion of a module into the vending apparatus 400 as well as ejection of a module from the vending apparatus 400. The motor or other active mechanism will, in some embodiments, be supported by the vending apparatus 400, and in other embodiments by the entertainment module 402.

The vending apparatus 400 includes one or more reservoirs 430 to contain and store goods for vending. In the illustrated embodiment of FIG. 4, these reservoirs are discrete and separate from the entertainment module 402. In other embodiments of the invention, however, reservoirs will be included as part of the entertainment module 402. In still other embodiments of the invention, entertainment module 402 may be transported with goods reservoirs that are pre-charged for vending. In such a case, replacement of the entertainment module 402 in a vending apparatus 400 concurrently provides recharged goods reservoirs.

Optionally, and as in the illustrated embodiment, the entertainment module 402 includes a distribution and path selection module 432. As discussed above with respect to FIG. 1, the distribution and path selection module controls the release of goods from one or more reservoirs and directs those goods into the entertaining mechanical user interface 404. In certain embodiments of the invention, the distribution and path selection module operates under control of a controller device. In certain embodiments, the controller device is integral to the entertainment module 402 and accordingly replaceable (and upgradeable) with the entertainment module. In other embodiments, the controller device is separate from the entertainment module 402 and is located elsewhere within, or outside of, the vending apparatus 400.

In the illustrated embodiment, entertainment module 402 includes a power and communications interface device 434 adapted to be coupled to a complementary power and communications interface device 436 of the vending apparatus 400. The power and communications interface device allows for the passage of, for example, electrical power and/or control signals to operate the entertainment module. In certain embodiments of the invention, the power and communications interface devices 434, 436 are arranged to automatically couple to one another for operative communications during insertion of the entertainment module 402 into the vending apparatus 400. Automatic decoupling during withdrawal of the entertainment module would likewise be effected.

As illustrated in FIG. 4 the vending apparatus 400 is provided with a door 438 arranged to limit access to the entertainment module 402 and to the balance of the interior of the vending apparatus 400. As illustrated, the door may include a window portion 440 having various substantially transparent regions. In addition, the door 438 may include further lighting apparatus. In certain embodiments, entertainment module 402 includes an integrated window and the window portion 440 exhibits an aperture so that the integrated window is exposed to the purchaser. As will become apparent below, such an integrated window may support a handle, or other manual input device, for manual control by a purchaser.

Figure 5A:
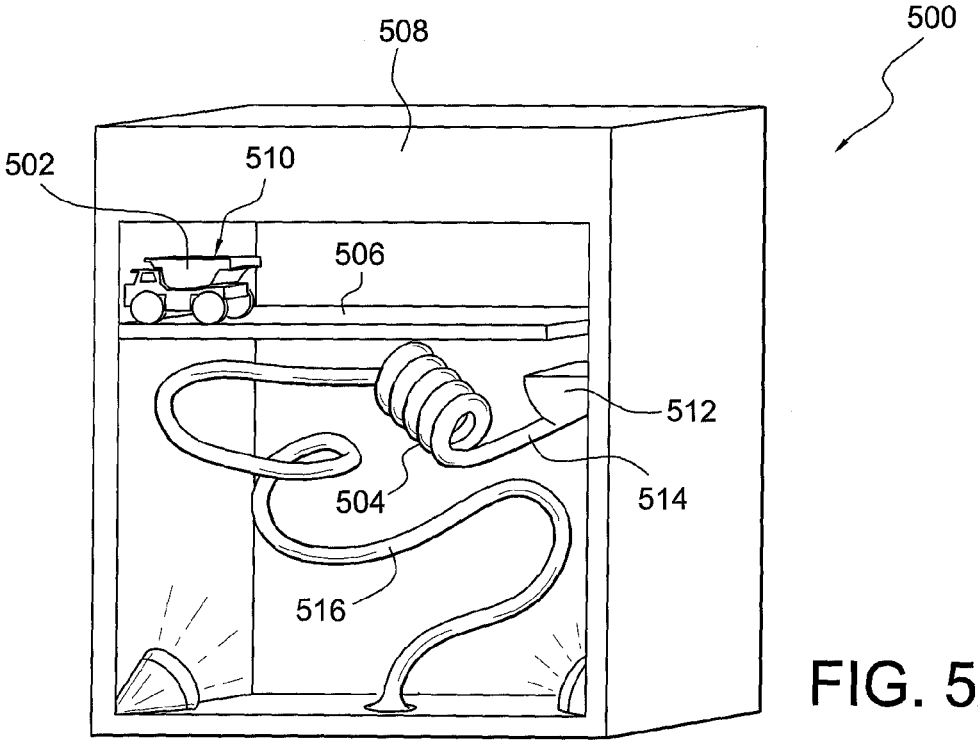
FIG. 5A shows, in schematic perspective view, an exemplary entertainment module according to principals of the invention.

FIG. 5A shows a further exemplary entertainment module 500 according to principles of the invention. The reader will understand that module 500 is configured and adapted for installation into the vending apparatus 400 of FIG. 4, upon withdrawal of entertainment module 402, so as to provide an alternative entertainment scenario to a purchaser. Replacement of entertainment modules in this fashion may be conducted on a regular schedule. Alternately, replacement may be made in response to sales information such as high sales volume, low sales volume and out of inventory indications, and on a stochastic basis, according to various exemplary replacement schemes.

Entertainment module 500 illustrates certain exemplary features including an active transportation device, shown here as a model dump truck 502. A further active transportation device is illustrated in the form of an Archimedes screw device 504. In light of the this illustration, one of skill in the art will understand that during operation, and optionally according to a selection by a purchaser, the dump truck 502 will move to an appropriate location by traveling across a shelf 506 under the control of a controller device. After the truck arrives at this location, goods are released from a reservoir by an operation of a distribution and path selection device 508, again under the control of the controller device. The released goods fall into a payload area 510 of the dump truck which may then optionally proceed to additional release points to receive additional goods, thereby forming a mixture of goods for vending.

In exemplary fashion, the dump truck 502 proceeds to an end of the shelf 506 where it activates a dumping function to release collected goods into a hopper 512. From a hopper 512, the goods proceed under gravitational urging through a distribution tube 514 to an inlet port of the Archimedean screw device 504.

The Archimedean screw device 504 operates in well understood fashion to elevate goods received at its inlet port to an outlet port where they are again received, for example, under gravitational influence through one or more entertaining tubes 516. Ultimately, the goods arrive at an exit port for product release, where they are dispensed to a purchaser.

The creative practitioner of ordinary skill in the art will readily understand that the illustrated active devices, such as the dump truck 502 and Archimedean screw device 504, are merely exemplary of many possible active devices which may be included for the entertainment of the purchaser, and which may be suggested to a designer in light of the present disclosure. In particular, it will be understood that while the illustrated devices suggest movement including relatively mild accelerations, impulsive devices will also be found in various embodiments of the invention. Accordingly, certain embodiments of the invention will include solenoid flappers, elastic devices, spring devices, and other devices configured to provide rapid and exciting acceleration of goods being vended, or other apparatus within the entertainment module.

In addition, it will be understood that such active devices may be equipped with various lighting and sound effects, and devices to produce the same, again with the objective of improving the entertainment experience of the purchaser, other potential purchasers, and other viewers.

Figure 5B:
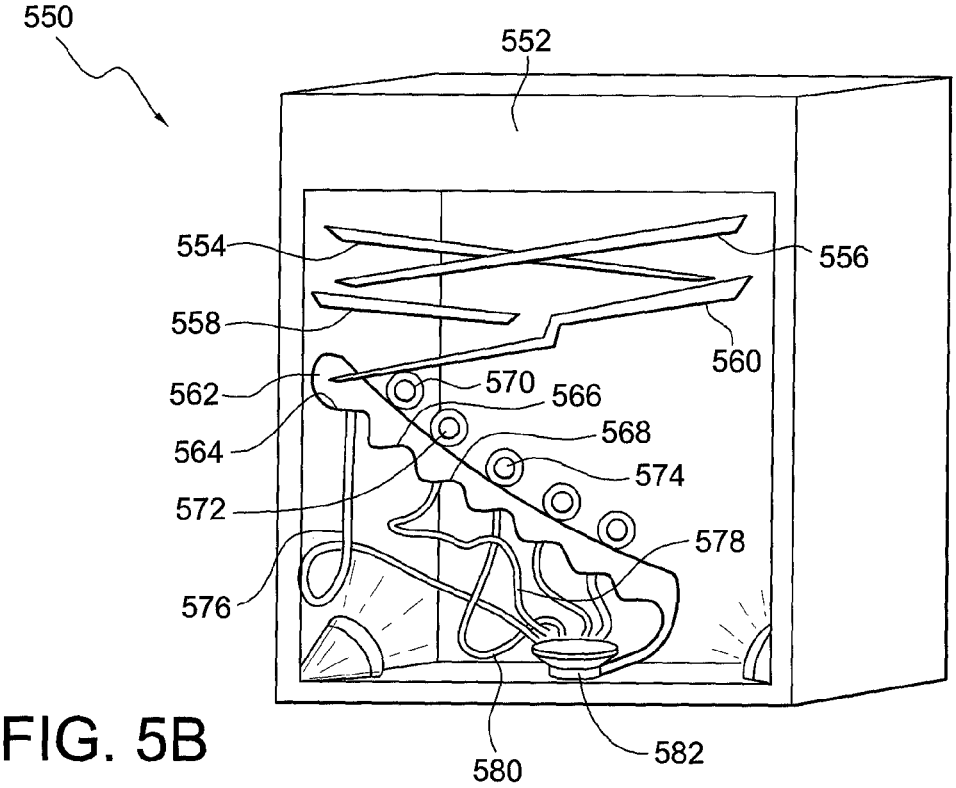
FIG. 5*b* shows, in schematic perspective view, a further example of an entertainment module according to principles of the invention.

FIG. 5B shows a further entertainment module 550 according to another exemplary embodiment of the invention. In the entertainment module 550 a distribution and path selection device 552 is arranged to release one or more goods from one or more reservoirs onto one or more exemplary ramps 554, 556. The goods proceed under the urging of gravity to further ramps 558 and/or 560, where they again proceed to an inlet of a step device 562. Thereafter, the goods descend the steps e.g., 564, 566, 568, again under the influence of gravity.

Exemplifying a further aspect of the invention, the entertainment module 550 includes one or more manual input devices, e.g., 570, 572, 574, each associated with a respective step of the step device. Where the manual input device is activated by a purchaser or other user prior to arrival of the goods at a respective step, the goods are diverted from the step device 562 into a corresponding tube, or other path device, e.g., 576, 578, 580. Thereupon, the goods proceed along the other path device to a product release point 582.

In certain embodiments, it will be possible for a purchaser or other user to activate more than one manual input device, concurrently or sequentially, so as to cause goods to proceed along a plurality of pathways to the point of distribution. Moreover, in some embodiments, activation of a manual input device will cause ancillary effects including lighting effects, audio effects and/or other entertaining results. Depending on the timing and nature of activation of a manual device, some or all of the goods dispensed may proceed to a lower release point 582 of the step device 562. In addition, in some embodiments a particular timing, or pattern, of activation of one or more of the manual devices, 570, 572, 574, along with possible stochastic conditions, will cause the release of additional goods or produce some other bonus or jackpot result.

Figure 6:
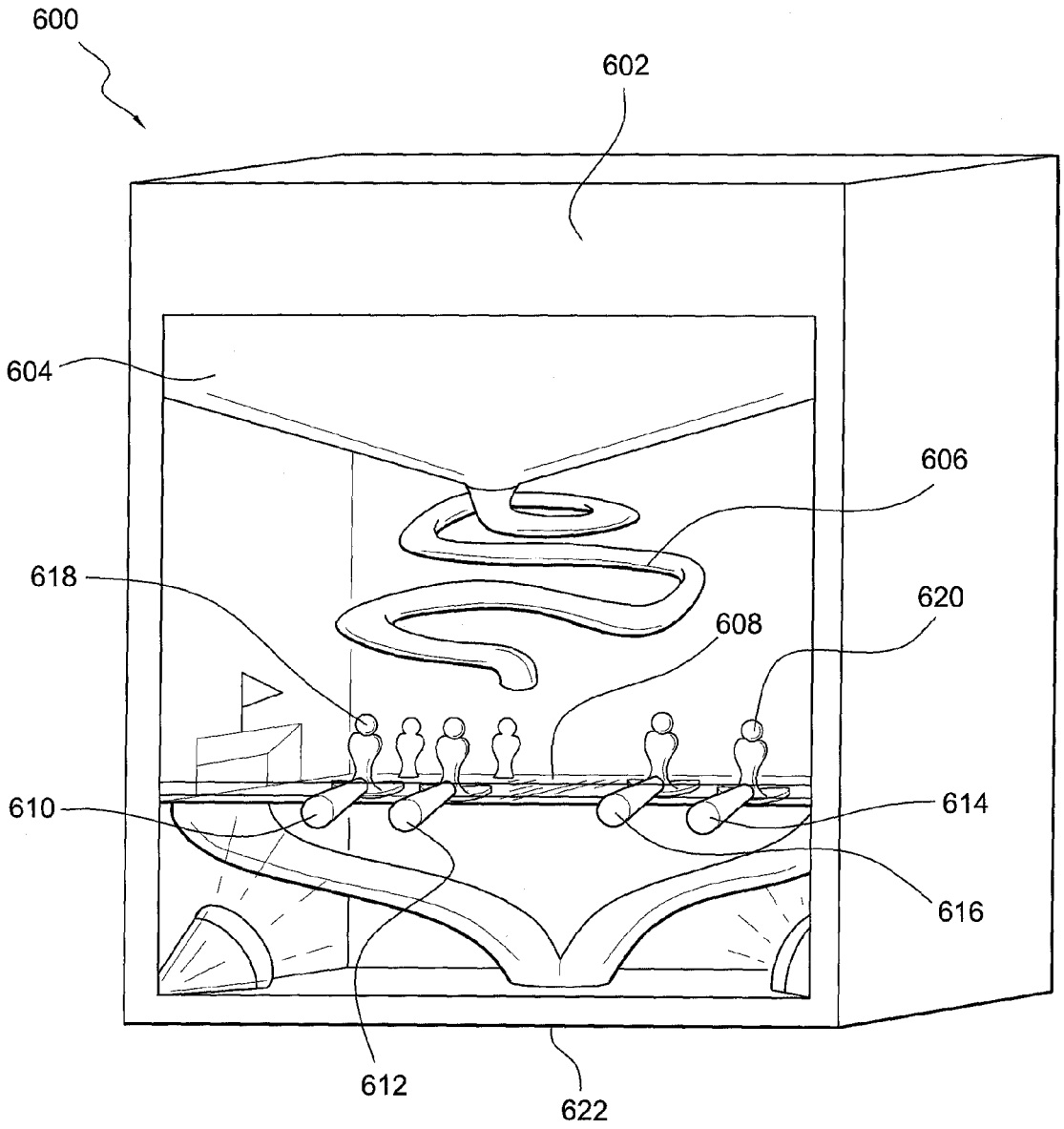
FIG. 6 shows, in schematic perspective view, a further example of an entertainment module according to principles of the invention.

FIG. 6 shows a further entertainment module 600 prepared according to principles of the invention. Consistent with previously described entertainment modules, entertainment module 600 includes a distribution and path selection device 602 arranged to receive goods from one or more reservoirs of goods and release those goods into an entertaining mechanical user interface. The user interface of entertainment module 600 includes, for exemplary purposes, a gravitationally fed hopper 604 and serpentine path device 606.

The serpentine path device 606 is arranged to release the goods onto, for example, a playing surface 608 where one or more of a purchaser and/or other users may interact with the goods by, for example, manually activating one or more handles or other manual devices, e.g., 610, 612, 614, 616. In the example shown in FIG. 6, the playing surface 608 is arranged as a "foosball field" where manipulation of the handles 610, 612, 614 and 616 allows users to activate corresponding figures (i.e., miniature mannequins) 618, 620, which are configured as soccer players on first and second teams. These figures may be manipulated to engage in a simulated soccer game using the goods in place of a soccer ball. As illustrated, the respective goal of each team is coupled to a corresponding tube so that, when a goal is scored, the goods are released for the tube and dispensed at an exit point 622.

It will be understood that the various entertaining devices described above are merely exemplary of a wide variety of systems and arrangements that may be provided for the entertainment of purchasers and others. In addition, it will be understood that such systems and arrangements will optionally include various active and passive devices as well as various manual interface devices for activation by one or more users. Also, it will be readily understood that, while the illustrated examples show primarily manual and mechanical devices, a wide variety of electrical and electronic actuators, devices, displays and interfaces may be employed to further promote the entertainment of the purchaser and of other viewers of the vending apparatus.

It will also be understood, in view of the disclosure above, that a single module or vending apparatus may include a plurality of entertaining arrangements and devices, which are configured to be manually and/or automatically exchanged with one another. For example a carousel of entertainment modules may be provided. In this way, different entertaining views may be provided without withdrawing a module from a machine. In addition, with or without a carousel, a particular entertaining user interface device may be arranged to reconfigure itself, so that for example, individual tubes may disconnect from one another and assume a new configuration under the urging of appropriate motors and/or other transducers.

Figure 7:
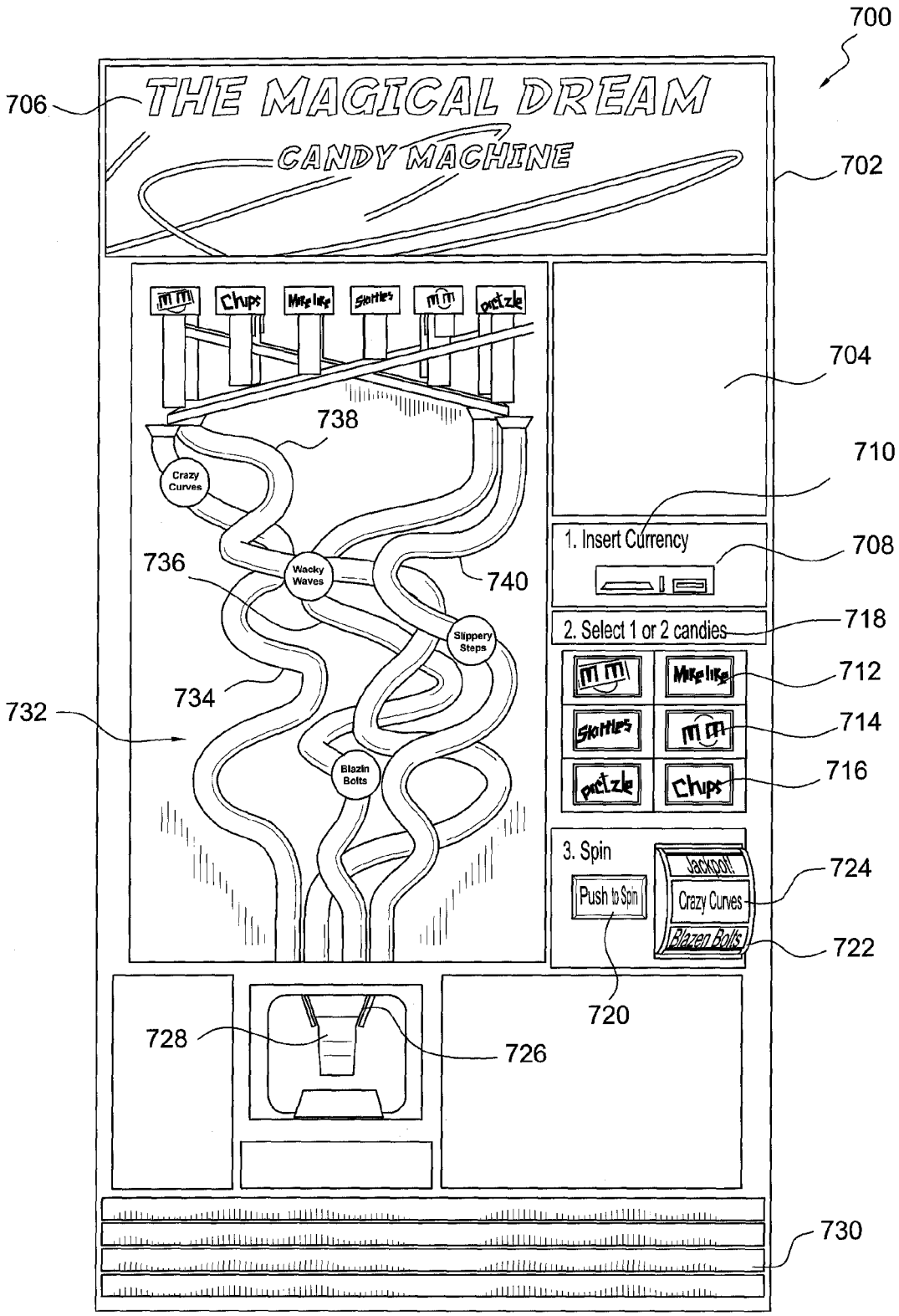
FIG. 7 shows, in schematic elevation, a further exemplary vending apparatus according to principles of the invention.

FIG. 7 shows still further aspects of a vending system according to the invention as exemplified in a vending apparatus 700. Vending apparatus 700 includes a cabinet 702 supporting a front panel and/or door 704. Exemplary signage 706, shown bearing a trademark, identifies and advertises the equipment and its products. A payment interface 708 is arranged to receive, in this case, paper bills, coins and credit cards, and is provided with an instructional legend 710.

A further electro-mechanical user interface includes a plurality of buttons, e.g., 712, 714, 716, again with a corresponding instructional legend 718. In a further entertaining aspect, the further user interface includes a randomizing "roulette feature" where a user can push a button 720 to cause a drum 722 to spin. The drum 722 is arranged to stop in one of several marked orientations 724 in random or pseudo-random fashion, and a quantity, selection or mixture of goods will be dispensed according to a specification associated with the particular marked orientation at which the drum stops. This specification may be fixed, or may be variable either by local reprogramming, or by the transfer of information from a remote server or device such as will be discussed in additional detail below.

In certain embodiments, the state of the drum when it stops determines which product will be dispensed, and the tube through which the dispensing will take place. For example, if the spin wheel lands on a legend reading "Crazy Curves" product will be dispensed through a tube labeled "Crazy Curves." It should be noted that the outcome identified by the randomization device may result in the dispensing of a particular candy, and in the dispensing of candy through a particular tube. These two selections may be independent of one another so that, for example, the drum may identify a particular product that may come through any tube, and the drum may also identify a particular tube through which any product is received. In addition, the state of the drum may identify both the product and the tube through which it is received.

In addition, the drum may identify different quantities of products for dispensing. Thus, in further embodiments of the invention, a jackpot or other indication will result in a larger volume of product dispensed. For example a jackpot may result in two different products being dispensed simultaneously or concurrently through two different tubes. In another example a jackpot may result in three different products being dispensed simultaneously through three different tubes. In certain embodiments, a purchaser will pre-select one or more preferred products and a jackpot will deliver an enhanced quantity of the pre-selected products, and/or a randomized combination of the pre-selected products.

In certain aspects of the invention, products may be prepackaged within, for example, plastic spheres. Each sphere may contain a specified quantity of products for vending. For example, a sphere may contain six candies. In certain embodiments, all spheres will contain a standard number of candies. A standard vending quantity may consist of one sphere or two spheres, or any other number of spheres according to the design of a particular vending scheme.

The use of spheres (or other packaging) allows for the delivery of standardized quantities of product, where a standard product delivery can consist of an integral number of spheres. Thus, for example, a purchaser may select a single product which will be delivered through a single tube as two spheres, each sphere containing, for example, six individual candies. Alternately, a purchaser may select two products which will be delivered as two spheres through two different tubes, one sphere containing six of the first product and the second sphere containing six of the second product. It will be understood, however that the quantity of products packaged within a sphere may be selected based on product size, product weight, or based on any other appropriate factor.

In the event that the purchaser chooses to employ the randomization "roulette wheel" two spheres will generally be delivered, but the product contained, and the tube through which the spheres are delivered, will be randomized and depend on the result of the roulette wheel spin. Among the possible outcomes, the purchaser may receive two spheres of the same candy or two spheres of different candies.

A further possible outcome of a roulette wheel spin is a "jackpot." A jackpot represents an exceptionally beneficial outcome. For example, in the event of a jackpot, a purchaser may receive four spheres of candy, randomly selected, rather than two spheres. It will be understood, of course, that the spheres are optional and that in certain embodiments of the invention, the described randomization can be effected using unpackaged goods.

In another aspect, a sphere may include a "release button" so that pressing on the release button causes the sphere to open and release its contents.

In some embodiments according to the invention, spheres may be received from a manufacturer, such as a candy manufacturer, pre-charged with particular goods. The contents of a pre-charged sphere may include a single product or a combination of products, and the dispensing apparatus will dispense spheres accordingly. In other embodiments, spheres and bulk product are stored within a vending machine and the spheres are charged with product within the machine prior to dispensing.

It should be noted that the described drum is merely exemplary of any number of randomization indicators including, for example, a roulette wheel, a spinning pointer, enclosed dice, and any other indicator of a stochastic gaming outcome. Together, the presence of multiple tubes, each having a different spatial configuration, the ability to select product and/or dispensing tube, the randomization offered by the roulette wheel (or other randomization device), and the opportunity to replace user interface modules from time to time, all increase the possibility that every user will have a substantially unique experience.

In addition, in certain embodiments, the purchaser may select a particular desirable mixture of bulk goods which is then prepared in visible and real time fashion as the goods pass through tubes or other pathways to the distribution point.

While a user interface is illustrated in FIG. 7 as including a variety of electro-mechanical features, one of skill in the art will readily understand that a fully electronic interface, an optical interface, or any combination thereof will be beneficially employed in various particular embodiments. Thus, touch-screen technology, as well as various sensing technologies including, without limitation, laser sensing, ultrasonic sensing, capacitive sensing, and radar sensing technologies, will be employed in various corresponding embodiments.

Vending apparatus 700 includes a product release device 726 adapted to deposit vended goods into a cup 728 such as, for example, a paper cup or a plastic cup. One of skill in the art will appreciate, however, that a wide variety of packaging, as well as no packaging, will be equally well employed in particular corresponding embodiments of the invention. Also visible in FIG. 7 is a grill 730 arranged to allow cooling air to flow, under the urging of appropriate equipment, to ensure proper cooling by any included refrigeration or other cooling apparatus.

Vending apparatus 700 is shown with an exemplary mechanical user interface 732, consistent with the previous descriptions and including a plurality of tubes 734, 736, 738 and 740. The mechanical user interface 732 may be modular, as described above with respect to FIG. 4, for example. Alternately, the mechanical user interface 732 may be permanently installed. In other embodiments of the invention, the mechanical user interface may be replaceable in parts, rather than as a unitary module. For example, individual tubes, e.g. 734, 736, 738, 740, or portions thereof, may be removable and replaceable. Such removable and replaceable parts may be provided individually and/or in kit form for replacement by appropriate dedicated or general-purpose service personnel.

As with the modular user interfaces described above, such part-replaceable user interfaces may include a wide variety of active and passive components, as well as replaceable actuators and audio and visual transducers, electronic displays, manual interface devices, and any other apparatus that will appropriately enhance a particular embodiment of the invention.

In a still further aspect of the invention, certain vending apparatus according to the invention will include integrated cleaning apparatus. Integrated cleaning apparatus will provide manual, i.e. frictional, cleaning of certain pathways and apparatus within the entertainment module and elsewhere within the apparatus. In other configurations and embodiments, flowing fluid such as compressed air, will provide a desirable lavage of the product distribution pathways and apparatus.

Figure 8:
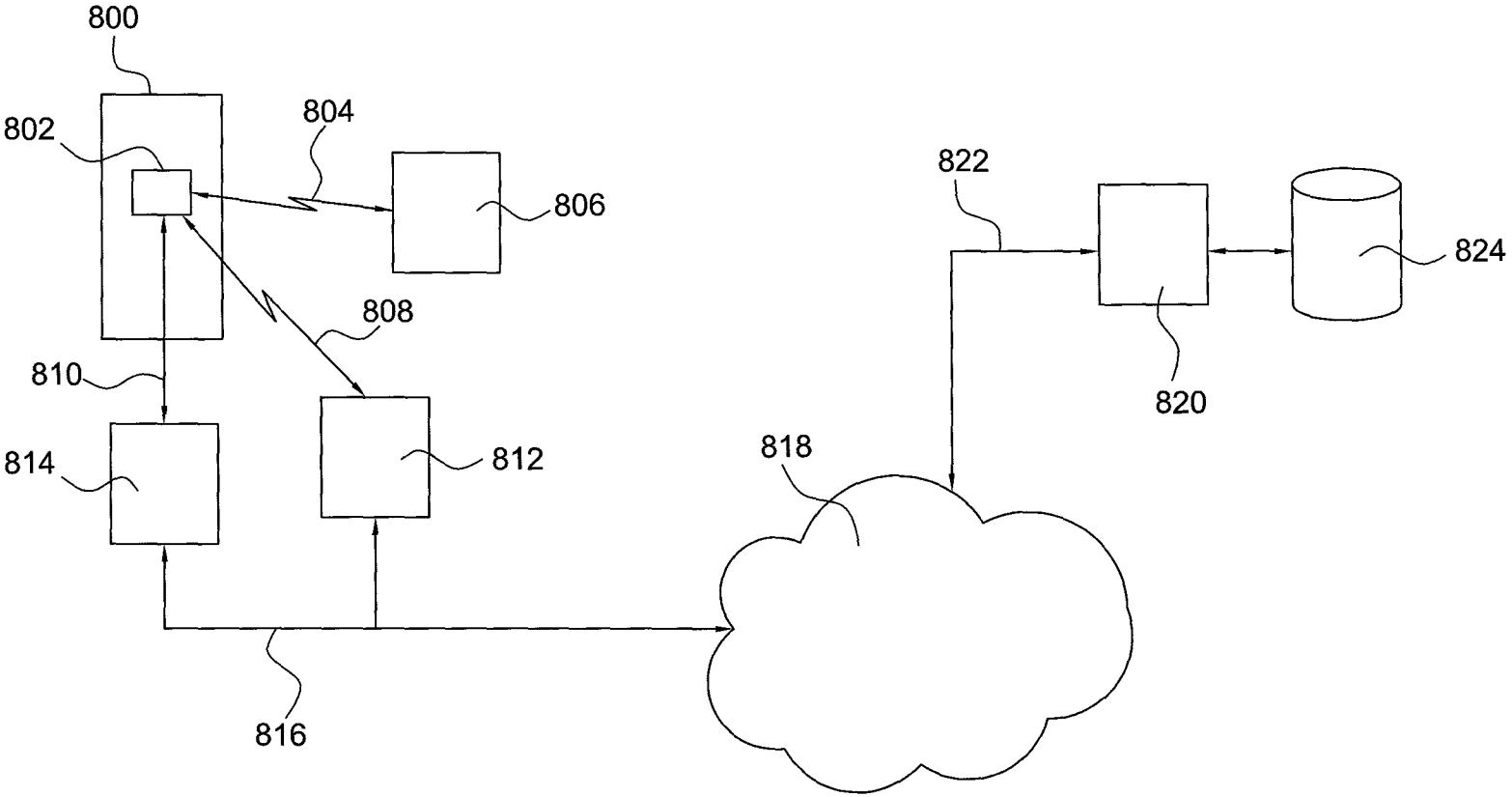
FIG. 8 shows, in schematic block diagram form, various communications equipment including a vending apparatus according to principles of the invention.

Referring again to FIG. 1, communication device 148 is arranged to provide communication between a controller device 120 and various external information sources and sinks. Making reference now to FIG. 8, a vending apparatus 800 is shown to include a communication device 802. In various embodiments, the communication device 802 will include appropriate components facilitating communications 804 with a user device 806 such as a cell phone or PDA of a purchaser or user located generally in proximity to the vending apparatus 800. The resulting communication channel may, in certain instances, allow for electronic payment or other exchange related to the purchase of goods. In addition, the resulting communication channel may, in certain instances, allow for the transfer of demographic information related to the user or purchaser.

Communication device 148 is also arranged, according to principles of the invention, and in certain embodiments, to communicate wirelessly 808 and/or in wired fashion 810 with one or more respective external communication devices 812, 814. These external communication devices, in turn, may be separately or mutually (as shown) coupled 816 to a network 818 for communication with remote devices. Such remote devices may include, for example, a server device 820 similarly connected 822 to network 818.

The server may be coupled to various storage devices 824, and may include a wide variety of user interface devices, memory devices, processor devices, communication devices, and other apparatus configured for information processing in a manner appropriate to the functions that will be described below.

Figure 9:
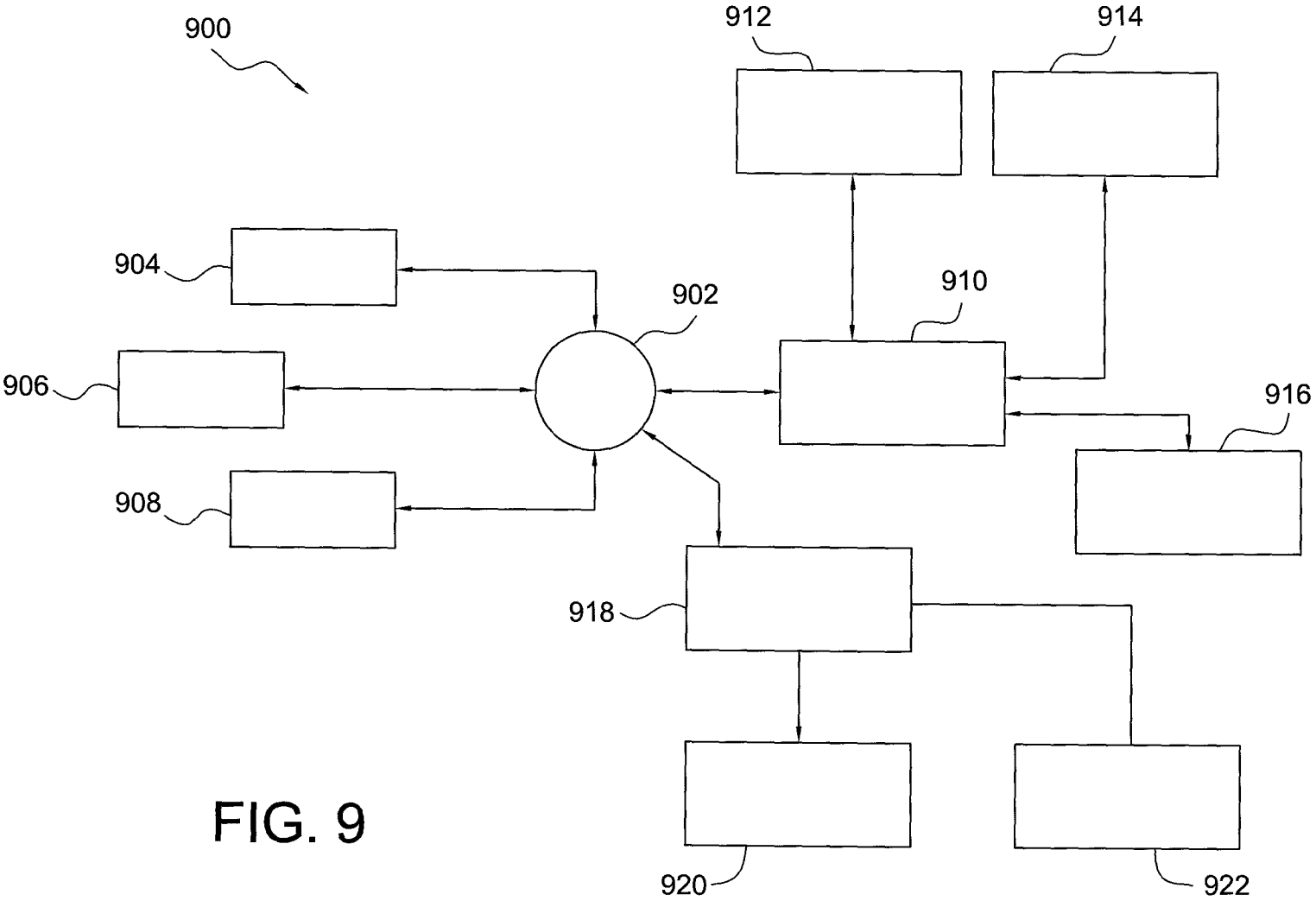
FIG. 9 shows, in schematic block diagram form, various communication and processing equipment including vending apparatus according to principles of the invention.

FIG. 9 illustrates, in block diagram form, a vending system 900 according to principles of the invention. The vending system 900 will be enabled by a server device such as that shown as 820 of FIG. 8. Within the server, a processor device 902 receives information from a plurality of vending apparatuses 904, 906, 908 by unidirectional and/or reciprocal communication with these devices. In addition, the processor device receives historical and market information from a storage device 910 which, in turn, receives information from a variety of sources such as a demographic information source 912, a sales historical information source 914, and various predictive model sources 916 arranged to suggest sale strategies and direct the deployment of various vending apparatus, entertainment modules, inventory items and mixtures, and packaging devices, among other functions.

The processor device 902, in turn, sends controlling signals and information to a distribution control device 918 which in turn communicates to provide advice and control to systems for the distribution of inventory 920 and vending apparatus 922, all according to principles of the invention. Accordingly, in certain aspects, the invention includes business methods for the receipt of information related to vending apparatus as described above, and for the distribution and control of inventory goods and vending apparatus in a coherent fashion.

In particular, a control system according to that outlined in FIG. 9 facilitates the operation of a leasing system, or other vending arrangement, configured to allow the placement of a plurality of vending apparatus in a respective plurality of vending locations. Electronic payment provided to the vending apparatus can be centrally received and accounted for at the processor device 902 as can inventory control levels and information. The proprietor of a particular vending location may then be compensated in monetary fashion or with other consideration, in exchange for availability of the location, or other benefits.

As discussed above, a roulette wheel or other randomization feature may provide randomization as to quantity, goods identity, and distribution path of a particular vending cycle. The roulette wheel is available only in certain embodiments of the invention and, in certain embodiments where it is available, its use is optional.

In certain embodiments of the invention, however, operation of the roulette wheel is integral and mandatory within a particular purchasing cycle. In one cycle, exemplary of such an embodiment, (after inserting payment) a purchaser selects one or more selections of goods by depressing corresponding selection buttons. Depending on the particular embodiment, a purchaser may be allowed to select one, two, three, four, or some other number of different candies, for example. In one embodiment a special button is provided that, when depressed, selects all available candies. Thereafter, the user must press a "roulette wheel" button.

Pressing the roulette wheel button causes the roulette, wheel to spin and produce an output state. The output state of the roulette wheel determines which dispensing tube the selected candies will be dispensed through. Thus, the assortment of candies is chosen by the purchaser, but the tube through which they are dispensed is determined at random based on the outcome of the roulette wheel spin.

As noted above, the candies may be dispensed within, for example, plastic globes, each globe containing a standard number of pieces of candy and an integer number of globes producing a standard candy distribution. Under some circumstances, when the roulette wheel returns a jackpot state the size of the candy distribution is increased over the standard value size, e.g., 25% more, doubled, etc.

In other embodiments, the roulette wheel has output states resulting in, for example, two candy selections being distributed through one randomized tube, two candy selections being distributed through another randomized tube, and so on for all tubes, with a further jackpot resulting in one candy being distributed but in an increased quantity, e.g. 25% more, through, for example, all tubes.

Figure 10:
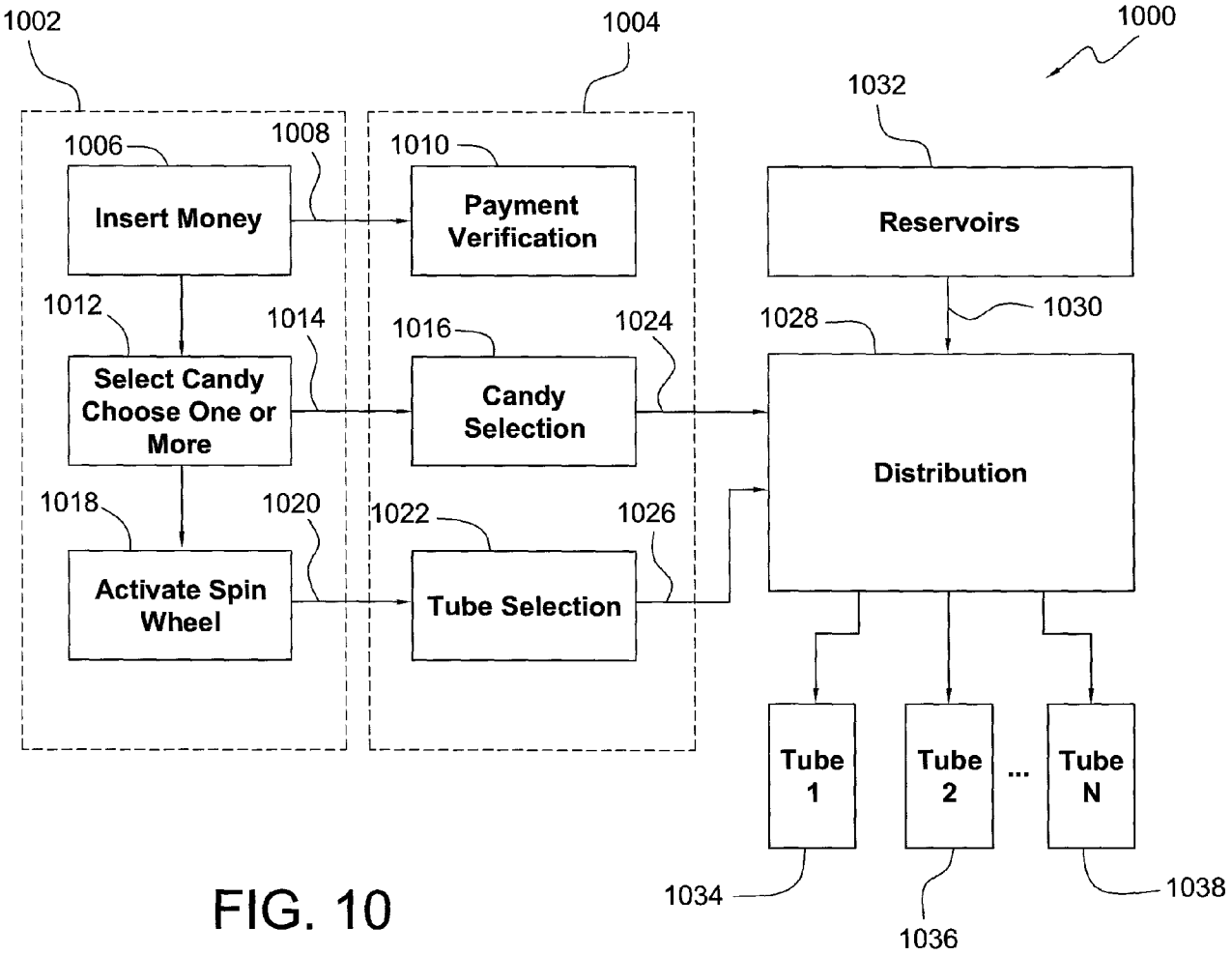
FIG. 10 shows, in schematic block diagram form, various communication and processing activities of equipment including vending apparatus according to principles of the invention.

In light of these further notes, FIG. 10 shows, in block diagram form, the operation 1000 of a vending machine according to principles of the invention. As illustrated, user inputs 1002 produce signals received by a processor portion 1004. For example, the insertion of money 1006 into the vending machine produces a signal 1008 received by the processor portion 1004 for payment verification 1010.

Thereafter, a user selects one or more preferred items for purchase 1012 by, for example, pressing one or more respective buttons. The processor portion 1004 receives a corresponding signal 1014 communicating to user's selection 1016 to the processor portion.

Subsequently, the user pushes a required further button, for example, to activate 1018 a randomization device such as a roulette wheel or spinning drum. When the randomization device stops, or otherwise enters a final state, a signal is received 1020 from the randomization device at the processor portion 1004. The processor portion interprets the received signal 1020 to determine a tube selection 1022 for distribution of the selected goods.

Having established a candy selection 1016 and a tube selection 1022, respective candy selection 1024 and tube selection 1026 signals are received at a distribution device 1028 from the processor portion 1004. The distribution device 1028, which receives candy 1030 from respective reservoirs 1032 distributes the candy received to one of a plurality of tubes 1034, 1036, 1038 which ultimately leads to dispensing of the candy.

Figure 11:
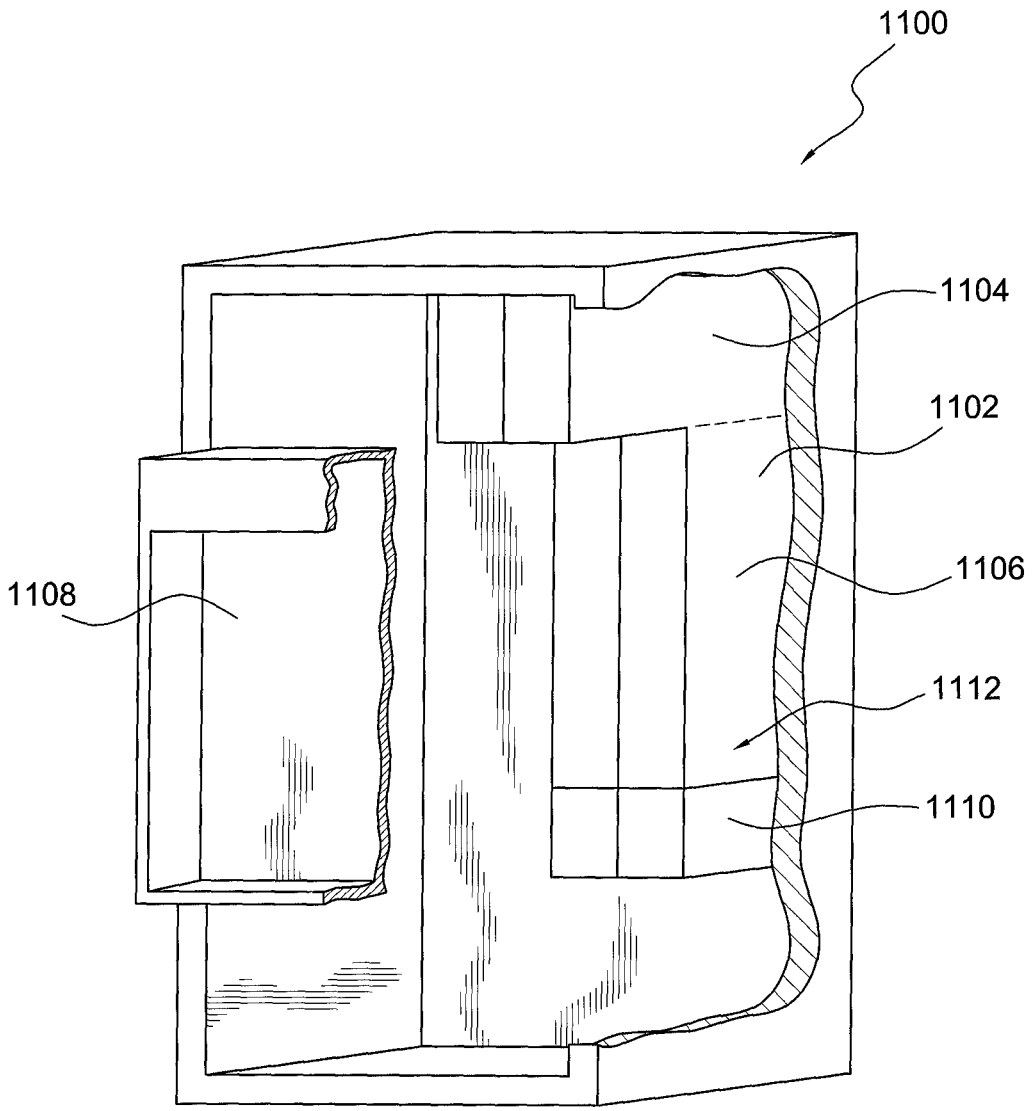
FIG. 11 shows, in cutaway perspective view, an exemplary vending apparatus including an extended reservoir module according to principles of the invention.

FIG. 11 shows, in cutaway perspective view an exemplary vending apparatus 1100 including an extended reservoir module 1102 according to principles of the invention. The extended reservoir module 1102 includes a first lateral portion 1104 and a second vertical portion 1106. In the illustrated embodiment, lateral portion 1104 is similar to, for example, reservoir 312 of FIG. 3. The vertical portion 1106 provides additional storage volume for bulk dispensing product, as compared with the reservoir 312 of FIG. 3. In the illustrated embodiment, the reservoir module 1102 is configured such that the vertical portion 1106 fits within the vending apparatus 1100 in an anterior region behind an entertainment module 1108. In certain embodiments the vertical portion 1106 significantly increases the overall reservoir volume available for storage and may substantially reduce replenishment frequency for a vending apparatus so equipped. As illustrated, the vertical portion 1106 has a substantially rectangular cross section (as taken in the horizontal plane). One of skill in the art will appreciate, however, that other configurations including, without limitation, polygonal and elliptical (including circular) will also be beneficially employed in various embodiments and applications.

According to principals of the invention, the vertical portion 1106 includes a lifting device 1110. The lifting device 1110 is configured and arranged to elevate goods stored within the vertical portion of 1106 of the reservoir module 1102 so as to replenish a store of goods as they are released from within the lateral portion 1104 of the reservoir module. Lifting device 1110 is represented schematically as coupled to a lower end 1112 of the vertical portion 1106. In various embodiments, however, the device 1110 will be disposed at different locations according to the requirements of a particular mechanical configuration. Thus, in certain embodiments, the lifting device will include components located within the interior of the reservoir module 1102, including within the vertical portion 1106 and/or the lateral portion 1104. In other embodiments, a portion of a lifting device will be disposed above the reservoir module 1102. In certain embodiments, the lifting device will be entirely disposed within the reservoir module and, in other embodiments, a greater or lesser portion of the lifting device mechanism will be disposed outwardly of the reservoir module.

In certain embodiments, the lifting device will be configured for replacement along with a respective module during inventory replenishment. That is, a reservoir module having a depleted or obsolete inventory of product will be removed from a vending apparatus and replaced with a pre-charged reservoir module that includes all or a portion of a lifting device. Such an embodiment allows for regular servicing and/or repair of a lifting device as part of a cleansing and replenishment cycle. In certain embodiments a lifting device will be formed as an integral element of the reservoir module and in other embodiments, a lifting device will include an assembly of components, at least some of which are removable from the reservoir module.

Figure 12:
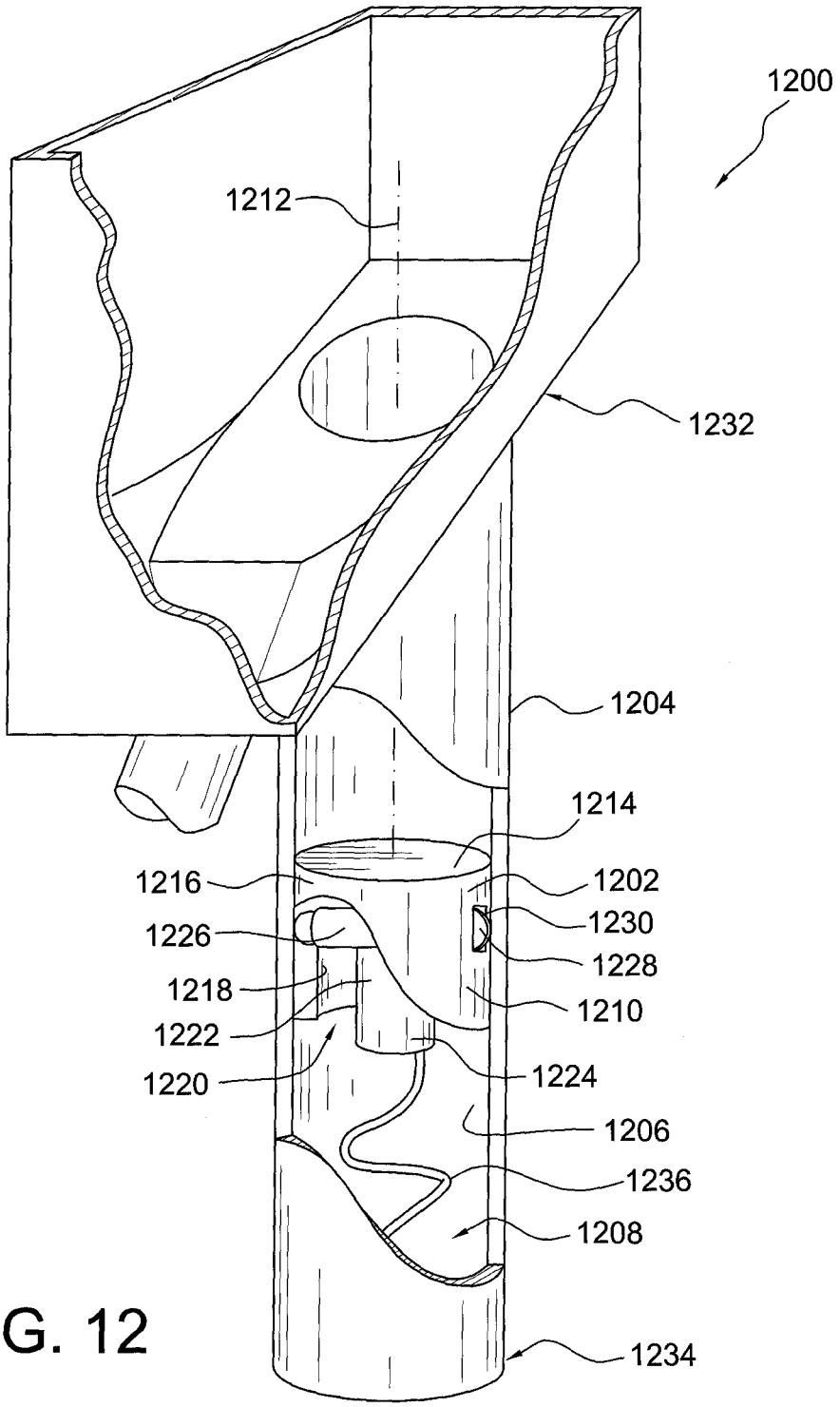
FIG. 12 shows, in cutaway perspective view, an extended reservoir module as a detail of a vending apparatus according to principles of the invention.

FIG. 12 shows, in cutaway perspective view, an extended reservoir module 1200 for a vending apparatus according to principles of the invention. The extended reservoir module 1200 includes an exemplary lifting device 1202 arranged and configured to elevate product inventory within a vertical portion 1204 of the reservoir module 1200. The vertical portion 1204 has an internal surface 1206 that defines a longitudinal cavity 1208 within the vertical portion 1204.

In the illustrated embodiment, the internal surface 1206 exhibits a generally circular cylindrical aspect, such that the longitudinal cavity has a generally circular cross section. One of skill in the art, however, will understand that any of a wide variety of internal surface configurations, and corresponding cross-sections, will be beneficially adapted for use in respective embodiments of the invention. A particular configuration will be selected based on various criteria including, without limitation, considerations of space optimization, mechanical strength and rigidity, reservoir weight, mechanical simplicity and efficiency of lifting apparatus, and combinations of these factors.

The illustrated lifting device 1202 includes a supporting device, shown here as a piston 1210. Piston 1210 is disposed within cavity 1208 and arranged to move slidingly through the cavity with a motion parallel to a longitudinal axis 1212 of the cavity 1210. The piston has an upper surface 1214 and a skirt having an outer circumferential surface 1216 and an inner circumferential surface 1218. The inner circumferential surface 1218 defines a recess or cavity 1220 within the piston 1210. A drive mechanism 1222 is disposed within the cavity 1220 and arranged to effect the sliding motion referred to above.

The drive mechanism 1222 illustrated in FIG. 12 includes a motor portion 1224, a transmission portion 1226 and at least one rotary coupling portion 1228. In the illustrated embodiment the rotary coupling portion 1228 includes a wheel having a circumferential surface 1230. The circumferential surface 1230 is configured and arranged to engage internal surface 1206. Rotation of the wheel proceeds when a rotary mechanical output of the motor 1224 is transferred through the transmission portion 1226 to the rotary coupling portion (or wheel) 1228. The rotation of the wheel 1228 results in generally linear motion of the piston 1202 upward (or downward) through the longitudinal cavity 1208.

The engagement between circumferential surface 1230 and internal surface 1206 is a primarily frictional engagement in the illustrated embodiment. With this in mind, the material of wheel 1228, and particularly, of circumferential surface 1230, will include a material selected for its frictional characteristics vis-à-vis a material of internal surface 1206. In certain embodiments, the material of the circumferential surface will include a metallic material. In other embodiments, the material of the circumferential surface 1230 will include a polymer material such as, for example, an elastomeric polymer.

In further embodiments of the invention, the circumferential surface 1230 will include a feature adapted to fortify engagement between the wheel 1228 and the internal surface 1206. For example in certain embodiments, the wheel 1228 is configured as a pinion gear having a plurality of gear teeth arrange circumferentially around the wheel. In certain embodiments, the gear teeth mesh with a linear rack coupled to internal surface 1206. In other embodiments, internal surface 1206 includes integral teeth molded or machined, for example, into the wall of the vertical reservoir portion 1204.

In additional embodiments, the circumferential surface 1230 includes a plurality of sprocket teeth and internal surface 1206 includes a corresponding chain feature, either coupled to the surface or integrally formed into it. In alternative embodiments, internal surface 1206 supports a timing belt, or includes a corresponding integrally formed feature, and circumferential surface 1230 includes complementary timing pulley teeth. In a still further embodiment, a cord or cable, such as, for example stainless steel aircraft cable, is disposed in tension between an upper end 1232 and lower end 1234 of the vertical reservoir portion 1204. The cord or cable includes at least one wrap around the wheel 1228 providing substantially positive frictional coupling between the cord or cable and the circumferential surface 1230, so as to facilitate driving of the piston 1202 through the longitudinal cavity 1208.

It will be understood by a practitioner of ordinary skill in the art, that the control of motor 1224 will be effected, for example, through power and/or control signals transmitted to the motor through and umbilical device 1236. In certain embodiments, the motor will be a rotary electrical motor such as, for example, a DC electrical motor and the umbilical will include at least one electrical cable. In other embodiments, the motor will be a pneumatic motor or a hydraulic motor, and the umbilical will include, respectively, at least one pressure hose for conducting an appropriate working fluid.

Figure 13:
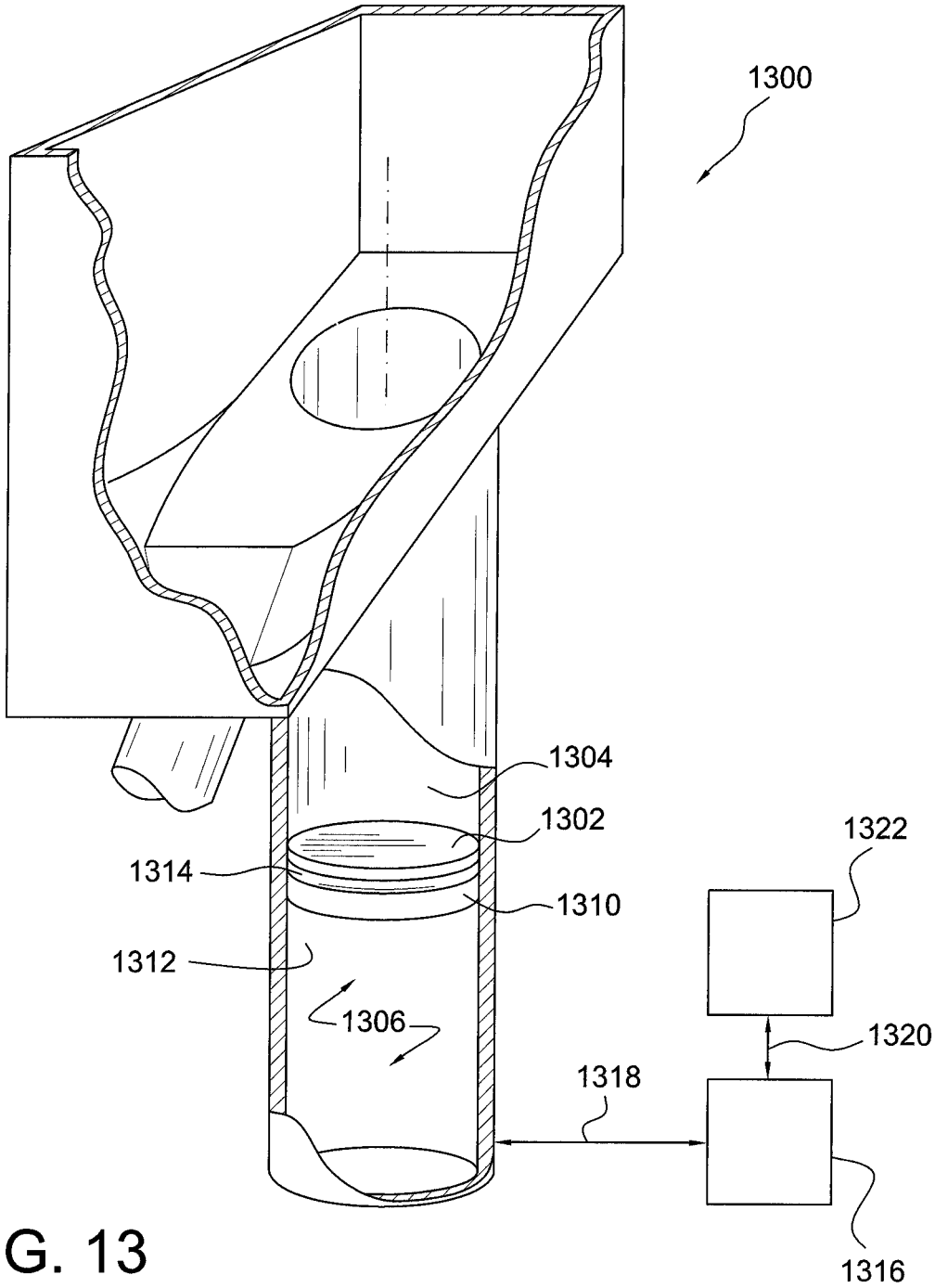
FIG. 13 shows, in cutaway perspective view, a further extended reservoir module as a detail of a vending apparatus according to principles of the invention.

FIG. 13 shows, in cutaway perspective view, an alternative extended reservoir module 1300 for a vending apparatus according to principles of the invention. The extended reservoir module 1300 includes a piston 1302 that does not necessarily have additional internal mechanisms. The piston will be advanced through a longitudinal cavity 1304 by injecting (or withdrawing) a working fluid within a further generally sealed cavity 1306 below the piston. Thus, for example, piston 1302 will serve as a pneumatic piston or a hydraulic piston for purposes of elevating inventory goods stored within the cavity above the piston. One of skill in the art will appreciate that, in such an embodiment, an appropriate seal will be required between an external circumferential surface 1310 of the piston 1302 and an internal surface 1312 of the reservoir module. In certain embodiments, this seal will include an elastomeric O-ring or other sealing ring 1314.

According to certain embodiments of the invention, a hydraulic pump or pneumatic compressor 1316 will be operatively coupled 1318 to cavity 1306. The pump or compressor 1316 will motivate the injection and withdrawal of working fluid into and out of the cavity 1306. In certain embodiments, the pump or compressor 1316 is operatively coupled 1320 to a control interface device 1322. In various embodiments, the interface control device 1322 will independently control the pump or compressor 1316, or will do so under the operative control of a further controller such as, for example, the entertainment and distribution control device 120 of FIG. 1.

In various embodiments of the invention, the pump or compressor 1316 will include a manifold and/or valves adapted to selectively couple the pump or compressor 1316 to any of a plurality of reservoirs within a vending apparatus. One of skill in the art will appreciate that control of the manifold and/or valves will also be beneficially subject to the control of a control interface device.

In certain further embodiments of the invention, the pump or compressor 1316 will be supplemented or replaced by a reservoir of working fluid stored under elastic compression. For example, a cylinder of compressed gas may be provided in place of the compressor 1316 in respective embodiments. In still further embodiments, chamber 1306 will be permanently (or replaceably) filled with a compressed gas, or will contain a gas or mechanical spring device adapted to automatically elevate piston 1302 in response to the dispensing of inventory and without the need for active control.

Figure 14:
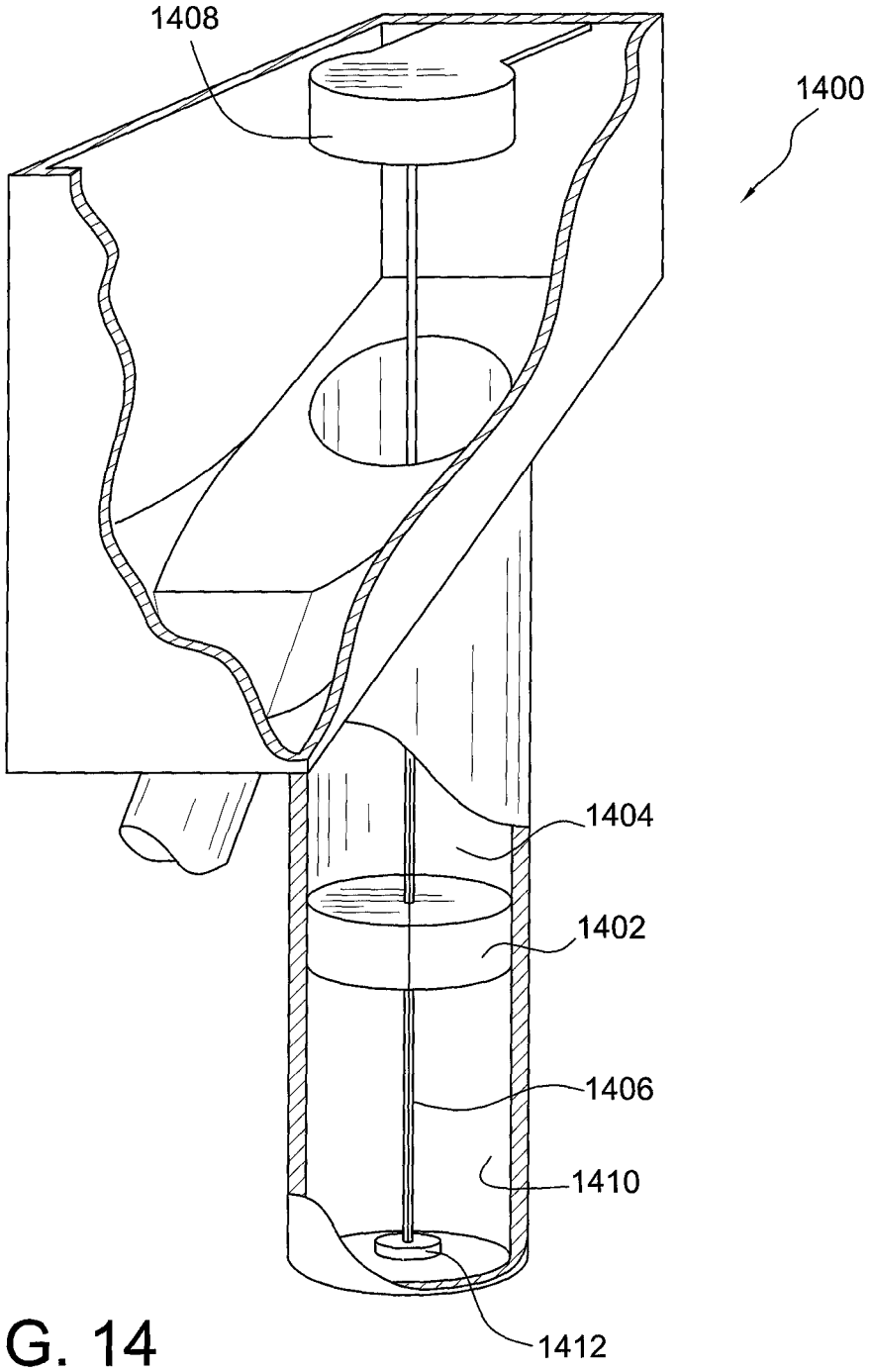
FIG. 14 shows, in cutaway perspective view, a still further extended reservoir module as a detail of a vending apparatus according to principles of the invention.

FIG. 14 shows, in cutaway perspective view, a further extended reservoir module 1400 for a vending apparatus according to principles of the invention. The extended reservoir module 1400 includes a piston 1402 and a mechanism for advancing the piston longitudinally through cavity 1404 along the cavity's longitudinal axis. The illustrated mechanism includes a lead screw or ballscrew 1406 operatively coupled to motor 1408. In the illustrated embodiment, the piston 1402 includes an internally threaded feature so that rotation of the lead screw or ballscrew 1406 urges linear motion of the piston 1402.

An internal surface 1410 of the module 1400 includes a feature such as a cross-sectional profile, a groove, or a longitudinal key, for example, adapted to prevent unwanted rotation of the piston about the ballscrew or lead screw. As illustrated, a bearing 1412 is optionally provided to support an end of the ballscrew or lead screw 1406 remote from the motor 1408. One of skill in the art will appreciate that the position of the bearing of the motor may be reversed, where desired, such that the motor is disposed at a lower end of the screw.

Figure 15:
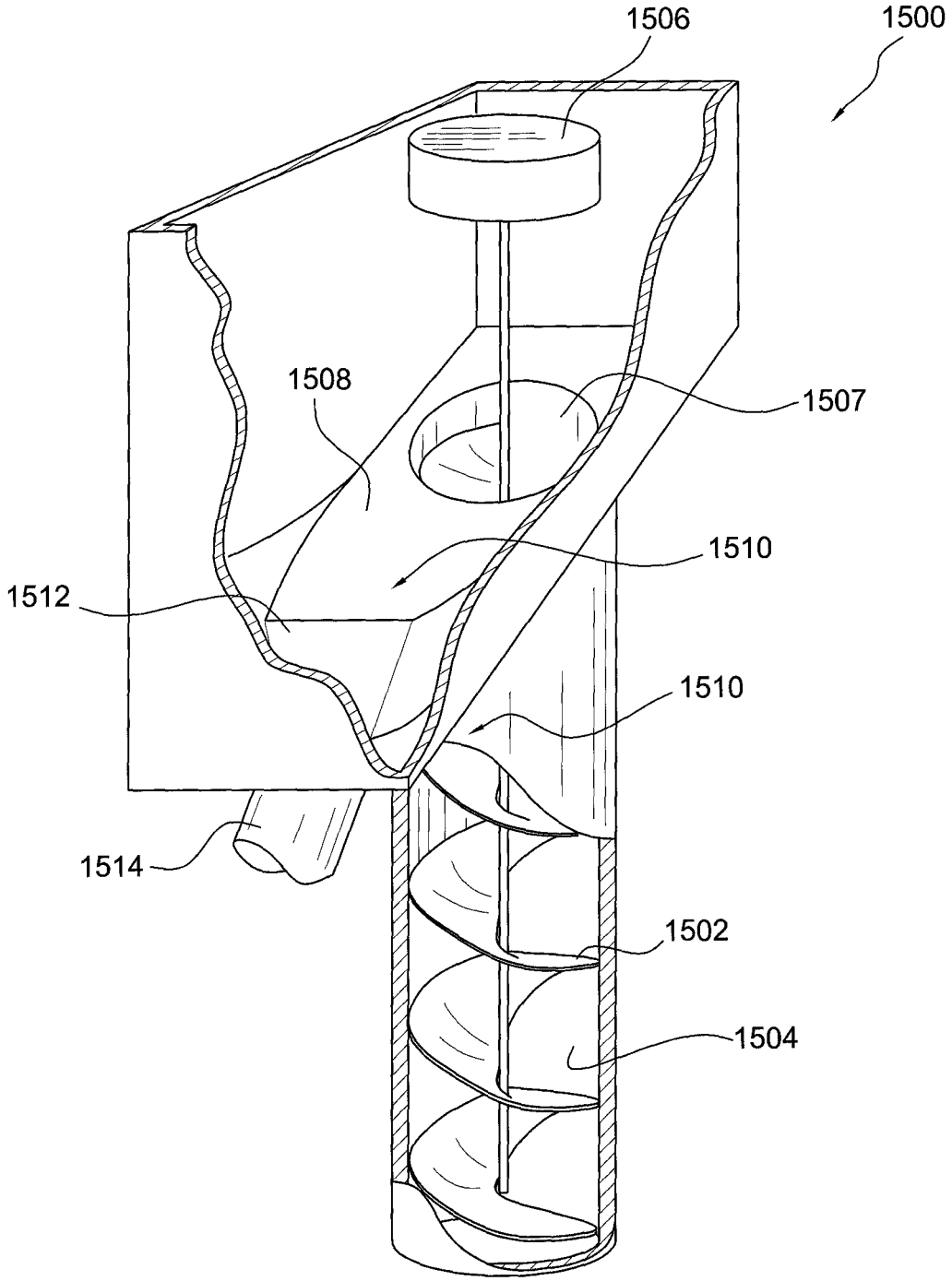
FIG. 15 shows, in cutaway perspective view, yet another extended reservoir module as a detail of a vending apparatus according to principles of the invention.

FIG. 15 shows, in cutaway perspective view, a further extended reservoir module 1500 for a vending apparatus according to principles of the invention. The extended reservoir module 1500 includes an Archimedean screw device 1502 adapted to advance inventory upwardly through cavity 1504 when rotary motion is impressed on the Archimedean screw 1502 by motor 1506. As with all of the motors noted above, the motor 1506 may include an electrical motor, pneumatic motor, a hydraulic motor, or any other motivating device effective to revive the desired rotary motion.

One of skill in the art will appreciate that rotation of the Archimedean screw will cause the elevation of goods stored within the cavity 1504. As goods are elevated, they pass upward through aperture 1507 and, in the illustrated embodiment, are drawn by gravity down inclined plane 1508. At the lower end 1510 of plane 1508 a hopper feature 1512 serves to guide the stored goods towards an aperture (not shown). Upon passing through the aperture, in certain embodiments, the goods pass into a tube 1514.

Figure 16:
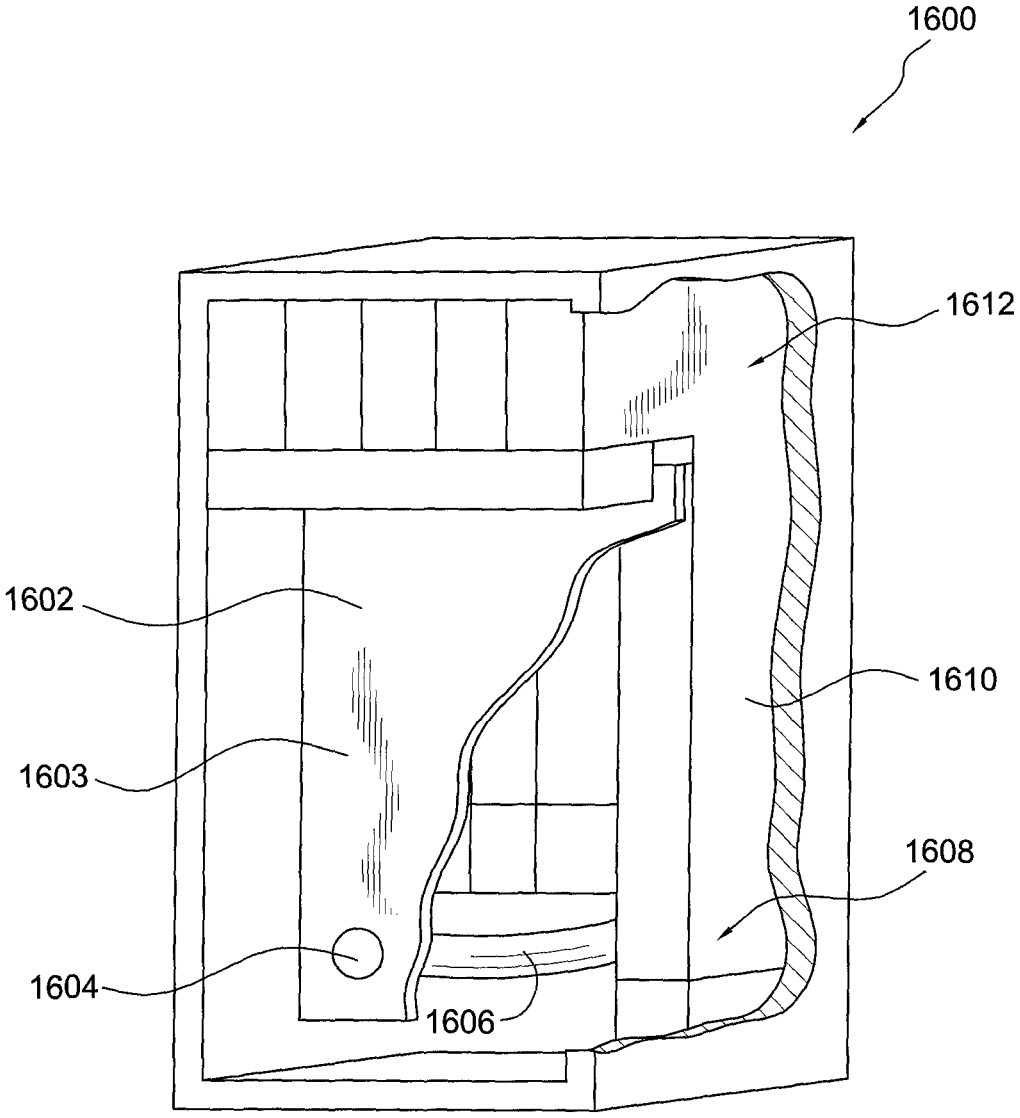
FIG. 16 shows in cutaway perspective view, an exemplary vending apparatus including a mechanism screen device and a non-release ball return as a detail of a vending apparatus according to principles of the invention.

FIG. 16 shows, in cutaway perspective view, a further aspect of a vending apparatus 1600 according to principles of the invention. Among other features, vending apparatus 1600 includes a dividing screen (or scrim) 1602. The dividing screen 1602 serves to conceal various internal portions of the vending apparatus from public view. The dividing screen 1602 includes a forward surface 1603 which may be decorated with various attractive literal images or abstract patterns. In certain embodiments of the invention, the dividing screen 1602 will be readily replaceable so that the attractive images can be updated from time to time.

Apparatus 1600 also includes an exemplary ball return aperture 1604. In certain embodiments of the invention, vending apparatus is provided with non-release balls. The non-release balls are, for example, released into the tubes of an entertainment module during the vending process. The non-release balls include non-release features that prevent their release from the vending apparatus to a customer. For example, a non-release ball may be larger than a typical dispensed good or good dispensing package so that it will not exit the machine through a properly sized dispensing aperture. Rather, the non-release balls are reused or recirculated after traversing the entertainment module. Thus, for example, after traversing the entertainment module, a non-release ball will enter aperture 1604 and traverse a return tube 1606. The return tube 1606 directs the non-release ball back into the lower end 1608 of a reservoir 1610. Thereafter, the non-release ball may be returned to an upper end 1612 of the reservoir by an apparatus such as the Archimedean screw apparatus described above. One of skill in the art will appreciate that, while the reservoir 1610 is schematically illustrated as being similar to the other goods reservoirs, the return mechanism for a non-release ball may be completely different from such a standard reservoir. Rather, the non-release return mechanism will be chosen as similar or different from the standard reservoir so as to optimize the system according to the requirements of a particular application.

A non-release ball may include various designs, including colorful designs, lights, bells and/or other noise makers, and any other feature beneficially adapted to make its passage through the entertainment module particularly entertaining to a viewer. In certain embodiments, the non-release ball will be substantially heavier than a typical portion (or configuration) of goods to be dispensed. Accordingly, the non-release ball, by its passage, may serve to dislodge any normal dispensing good that becomes lodged or otherwise trapped within the entertainment module. Consequently, the non-release ball may serve both an entertainment purpose and a maintenance purpose.

The availability of the technical systems described above will facilitate various further technical business methods that will be apparent to one of skill in the art in light of the foregoing descriptions including, for example, the vending of demographic information collected at particular remote vending apparatus according to customer usage.

While the exemplary embodiments described above have been chosen primarily from the field of candy and novelty sales including, without limitation, foodstuffs, snacks, beverages, confectionery products, toys, puzzles and other games of many descriptions and forms, one of skill in the art will appreciate that the principles of the invention are equally well applied, and that the benefits of the present invention are equally well realized in a wide variety of other vending systems including, for example, systems for the vending of lottery tickets and other gambling tokens, substantial food items, travel vouchers, and other vendable items. Further, while the invention has been described in detail in connection with the presently preferred embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Accordingly, the invention is not to be seen as limited by the foregoing description, but is only limited by the scope of the appended claims.

The invention claimed is:

1. A vending apparatus comprising:

a plurality of reservoirs;

a distribution control device;

a dynamic user interface including a multipath serpentine visible goods guidance device;

and a controller device, said controller device being adapted to provide a dynamically configured release of a mixture of goods to said multipath serpentine visible goods guidance device by said distribution control device, whereby said mixture and said dynamic user interface combine to offer enhanced entertainment to a viewer and wherein a reservoir of said plurality of reservoirs comprises a first generally horizontal portion and a second generally vertical portion, said second generally vertical portion including a feed mechanism for elevating stored goods into said generally horizontal portion.

2. A vending apparatus as defined in claim 1 wherein said feed mechanism comprises a motorized lift for elevating stored goods.

3. A vending apparatus as defined in claim 2 wherein said motorized lift comprises a threaded device and an electric motor.

4. A vending apparatus as defined in claim 2 wherein said motorized lift comprises a rack and pinion device.

5. A vending apparatus as defined in claim 2 wherein said motorized lift comprises an Archimedean screw.

6. A vending apparatus as defined in claim 1 wherein said feed mechanism comprises a pneumatic cylinder device.

7. A vending apparatus as defined in claim 1 wherein said feed mechanism comprises a hydraulic cylinder device.

8. A vending apparatus as defined in claim 1 wherein said feed mechanism comprises an elastic device, said elastic device being arranged to urge stored goods upward into said first horizontal portion.

9. A vending apparatus as defined in claim 8 wherein said elastic device tends to expand as said stored goods move upward.

10. A vending apparatus as defined in claim 8 wherein said elastic device comprises a gas.

11. A vending apparatus as defined in claim 1 wherein said second generally vertical portion has a lower end, said lower end being adapted to be received within said vending apparatus substantially adjacent to a floor of said vending apparatus.

12. A vending apparatus as defined in claim 1 wherein said second generally vertical portion has a generally circular horizontal cross-section.

13. A vending apparatus as defined in claim 1 wherein said second generally vertical portion has a generally rectangular horizontal cross-section.

14. A vending apparatus as defined in claim 1 wherein a reservoir of said plurality of reservoirs has a height substantially equal to an interior height of said vending apparatus.

15. A vending apparatus as defined in claim 1 wherein said first generally horizontal portion comprises an inclined surface and a hopper, said inclined surface and hopper being adapted to promote gravitational feeding of said stored goods.

* * * * *